US007065315B2

(12) United States Patent
Kinouchi et al.

(10) Patent No.: US 7,065,315 B2
(45) Date of Patent: Jun. 20, 2006

(54) FIXING APPARATUS

(75) Inventors: Satoshi Kinouchi, Tokyo (JP); Osamu Takagi, Chofu (JP); Yoshinori Tsueda, Fuji (JP); Toshihiro Sone, Fujieda (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 39 days.

(21) Appl. No.: 10/872,472

(22) Filed: Jun. 22, 2004

(65) Prior Publication Data

US 2004/0265021 A1 Dec. 30, 2004

(30) Foreign Application Priority Data

Jun. 30, 2003 (JP) ..... 2003-188634
Nov. 19, 2003 (JP) ..... 2003-389751

(51) Int. Cl.
*G03G 15/20* (2006.01)

(52) U.S. Cl. ..... 399/334; 399/330; 399/328

(58) Field of Classification Search ..... 399/344, 399/330, 335, 33; 165/89; 219/671, 672, 219/675, 667; 492/46
See application file for complete search history.

(56) References Cited

U.S. PATENT DOCUMENTS 4,891,484 A * 1/1990 Waggott et al. ..... 219/671
5,666,627 A * 9/1997 Yamaguchi ..... 399/330
5,819,150 A * 10/1998 Hayasaki et al. ..... 399/330
6,026,273 A 2/2000 Kinouchi et al.
6,078,781 A 6/2000 Takagi et al.
6,087,641 A 7/2000 Kinouchi et al.
6,097,926 A 8/2000 Takagi et al.
6,137,985 A 10/2000 Kinouchi et al.
6,154,629 A 11/2000 Kinouchi et al.
6,337,969 B1 1/2002 Takagi et al.
6,415,128 B1 7/2002 Takagi et al.
6,438,335 B1 8/2002 Kinouchi et al.
6,463,252 B1 * 10/2002 Omoto et al. ..... 399/330
6,643,476 B1 11/2003 Kinouchi et al.
6,643,491 B1 11/2003 Kinouchi et al.
6,724,999 B1 4/2004 Kikuchi et al.
6,725,000 B1 4/2004 Takagi et al.
6,763,206 B1 7/2004 Kinouchi et al.
2002/0007752 A1 * 1/2002 Sakagami ..... 101/487
2003/0002882 A1 * 1/2003 Takagi et al. ..... 399/69

(Continued)

FOREIGN PATENT DOCUMENTS

JP 7-295414 A 11/1995

(Continued)

OTHER PUBLICATIONS

U.S. Appl. No. 10/799,770, filed Mar. 15, 2004, Kikuchi et al.

(Continued)

*Primary Examiner*—Arthur T. Grimley
*Assistant Examiner*—Laura K Roth
(74) *Attorney, Agent, or Firm*—Foley & Lardner LLP

(57) ABSTRACT

A fixing apparatus of one embodiment of the present invention has a heating member which is heated by induction heating, a pressing member which supplies a predetermined pressure to the heating member, and induction heating mechanisms which supply a predetermined magnetic field to the heating member. The induction heating mechanisms have a plurality of coils. By arranging the adjacent coils and adjacent coils to overlap, the temperature distribution in the length direction of the heating member can be made uniform.

19 Claims, 19 Drawing Sheets

U.S. PATENT DOCUMENTS

| | | | | |
|---|---|---|---|---|
| 2003/0219269 | A1* | 11/2003 | Asayama | 399/67 |
| 2003/0219271 | A1 | 11/2003 | Kinouchi et al. | |
| 2004/0141038 | A1 | 7/2004 | Takagi et al. | |
| 2004/0173603 | A1 | 9/2004 | Kinouchi et al. | |
| 2004/0175211 | A1 | 9/2004 | Sone et al. | |
| 2004/0175212 | A1 | 9/2004 | Tsueda et al. | |
| 2004/0179874 | A1 | 9/2004 | Kinouchi et al. | |
| 2004/0184852 | A1 | 9/2004 | Takagi et al. | |
| 2004/0188421 | A1 | 9/2004 | Takagi et al. | |
| 2004/0188422 | A1 | 9/2004 | Wasai et al. | |
| 2004/0238531 | A1 | 12/2004 | Kikuchi et al. | |

FOREIGN PATENT DOCUMENTS

| | | | | |
|---|---|---|---|---|
| JP | 8-076620 | A | | 3/1996 |
| JP | 8-129313 | A | | 5/1996 |
| JP | 2000-206813 | A | | 7/2000 |
| JP | 2001-005315 | A | | 1/2001 |
| JP | 2001066918 | A | * | 3/2001 |
| JP | 2001-235962 | A | | 8/2001 |
| JP | 2002-040839 | A | | 2/2002 |
| JP | 2002-082549 | A | | 3/2002 |

OTHER PUBLICATIONS

U.S. Appl. No. 10/805,522, filed Mar. 22, 2004, Kikuchi et al.
U.S. Appl. No. 10/805,514, filed Mar. 22, 2004, Kinouchi et al.
U.S. Appl. No. 10/805,308, filed Mar. 22, 2004, Tsueda et al.
U.S. Appl. No. 10/805,507, filed Mar. 22, 2004, Kikuchi et al.
U.S. Appl. No. 10/805,420, filed Mar. 22, 2004, Sone et al.
U.S. Appl. No. 10//805,305, filed Mar. 22, 2004, Sone et al.
U.S. Appl. No. 10/820,138, filed Apr. 8, 2004, Sone et al.

* cited by examiner

FIXING APPARATUS

CROSS-REFERENCE TO RELATED APPLICATIONS

This application is based upon and claims the benefit of priority from prior Japanese Patent Applications No. 2003-188634, filed Jun. 30, 2003; and No. 2003-389751, filed Nov. 19, 2003, the entire contents of both of which are incorporated herein by reference.

BACKGROUND OF THE INVENTION

1. Field of the Invention

The present invention relates to a fixing apparatus for fusing a developer to a transfer material, which is provided in an image forming apparatus using an electrophotographic process to form an image on a transfer material, such as a copier and printer.

2. Description of the Related Art

An image forming apparatus such as an electric copier has a fixing apparatus for fusing a heated and fused developer image to a paper sheet by applying pressure.

As a method of heating a heating member of a fixing apparatus, induction heating is available. Induction heating is a method of generating a magnetic field by applying a predetermined electric power to a coil to generate a magnetic field and generating a predetermined amount of heat in a heating member by Joule heat generated by an eddy current generated by the magnetic field.

For example, Jpn. Pat. Appln. KOKAI Publication No. 2001-235962 discloses a fixing apparatus using an induction heating method, in which a coil having an area where a heating member contacts a paper sheet is arranged opposite to a divided heating area, is divided into a predetermined number of coils according to the size of paper, and placed outside the heating member.

Further, Jpn. Pat. Appln. KOKAI Publication No. 2000-206813 discloses a fixing apparatus using an induction heating method, which has a plurality of exciting coils, and controls the amount of current supplied to the exciting coils except a first exciting coil according to the amount of current supplied to the first exciting coil.

Further, Jpn. Pat. Appln. KOKAI Publication No. 7-295414 discloses a fixing apparatus using an induction heating method, which has a plurality of coils placed outside of a heating member, having an area where a heating member contacts a paper sheet, is arranged opposite to a divided heating area, according to the size of paper heated by the heating member, and a current is supplied independently to the plurality of coils.

In the fixing apparatuses using the induction heating method as disclosed by the above three patent publications, a heating member having a very high heating efficiency is heated very quickly, and if it is heated in the state not rotated, the area near the part opposite to the exciting coil is locally heated.

Further, Jpn. Pat. Appln. KOKAI Publication No. 2002-40839 discloses a fixing apparatus which has a fusing belt heated by a heating roller heated by an induction heating method, and a detection means which detects movement of the fusing belt in the rotating direction.

Further, Jpn. Pat. Appln. KOKAI Publication No. 2002-82549 discloses a fixing apparatus, in which a part of a belt contacting a passing paper sheet heated by a heating member is separated from a part cooperating with a pressing member to supply a predetermined pressure to a paper sheet, and the heating member starts induction heating after the belt is rotated.

Among the fixing apparatuses using an induction heating method, the fixing apparatus which uses a plurality of coils for induction heating may have a weak magnetic field strength supplied to the area adjacent to the coil, compared with the magnetic field supplied close to the center of the coil. In this case, the magnetic field intensity varies in the length direction of the heating member, and the heat amount changes depending on the positions of the heating member.

Therefore, the distribution of temperatures in the length direction of the heating member becomes nonuniform, and the heat value supplied to the developer on a paper sheet becomes unstable.

In a heating roller with a thin metallic layer noticed in recent years, the temperature difference that occurs particularly among a plurality of coils becomes a problem.

As for a detection means for detecting an abnormal temperature, it is demanded to detect a temperature at a predetermined position heated locally by an exciting coil.

However, in a fixing apparatus which does not contain an exciting coil and a means for detecting an abnormal temperature, because the heating member is filled inside, it is physically difficult to place a temperature detection means at a predetermined position that is locally heated, for example, between a coil and a heating member.

Besides, there is a problem in the fixing apparatus which uses a heating member with a filled inside. As an abnormal temperature detection means for detecting an abnormal temperature is arranged close to an exciting coil, a magnetic field is not evenly supplied from the exciting coil to the heating roller, and the temperature is not held uniform in the rotating direction of the heating member.

BRIEF SUMMARY OF THE INVENTION

According to an aspect of the present invention, there is provided a fixing apparatus comprising:

a heating member which is shaped cylindrical and has a conductor to flow an induced current by induction heating;

a pressing member which supplies a pressure to the heating member;

a first induction heating mechanism which includes a first coil;

a second induction heating mechanism which includes at least one of second coils aligned with the first induction heating mechanism in the axial direction of the heating member;

wherein the first coil has a part with a different distance to the heating member.

According to another aspect of the present invention, there is provided a fixing apparatus comprising:

a heating member which is shaped cylindrical and has a conductor to flow an induced current by induction heating;

a pressing member which supplies a pressure to the heating member;

a first induction heating mechanism which includes a first coil;

a second induction heating mechanism which includes at least one of second coils aligned with the first induction heating mechanism in the axial direction of the heating member;

wherein the heating member receives the influence of magnetic field generated from the both first and second coils, in the area divided in the direction orthogonal to the axial direction.

According to another aspect of the present invention, there is provided a fixing apparatus comprising:

a heating member which is shaped cylindrical and has a conductor to flow an induced current by induction heating;

a pressing member which supplies a pressure to the heating member;

a first induction heating mechanism which includes a first coil;

a second induction heating mechanism which includes at least one of second coils arranged at an angle and phase different from those of the first coil of the first induction heating mechanism;

wherein the heating member receives the influence of magnetic field generated from the both first and second coils, in the area divided in the direction orthogonal to the axial direction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

Hereinafter, embodiments of the present invention will be explained in detail with reference to the accompanied drawings.

Figure 1:
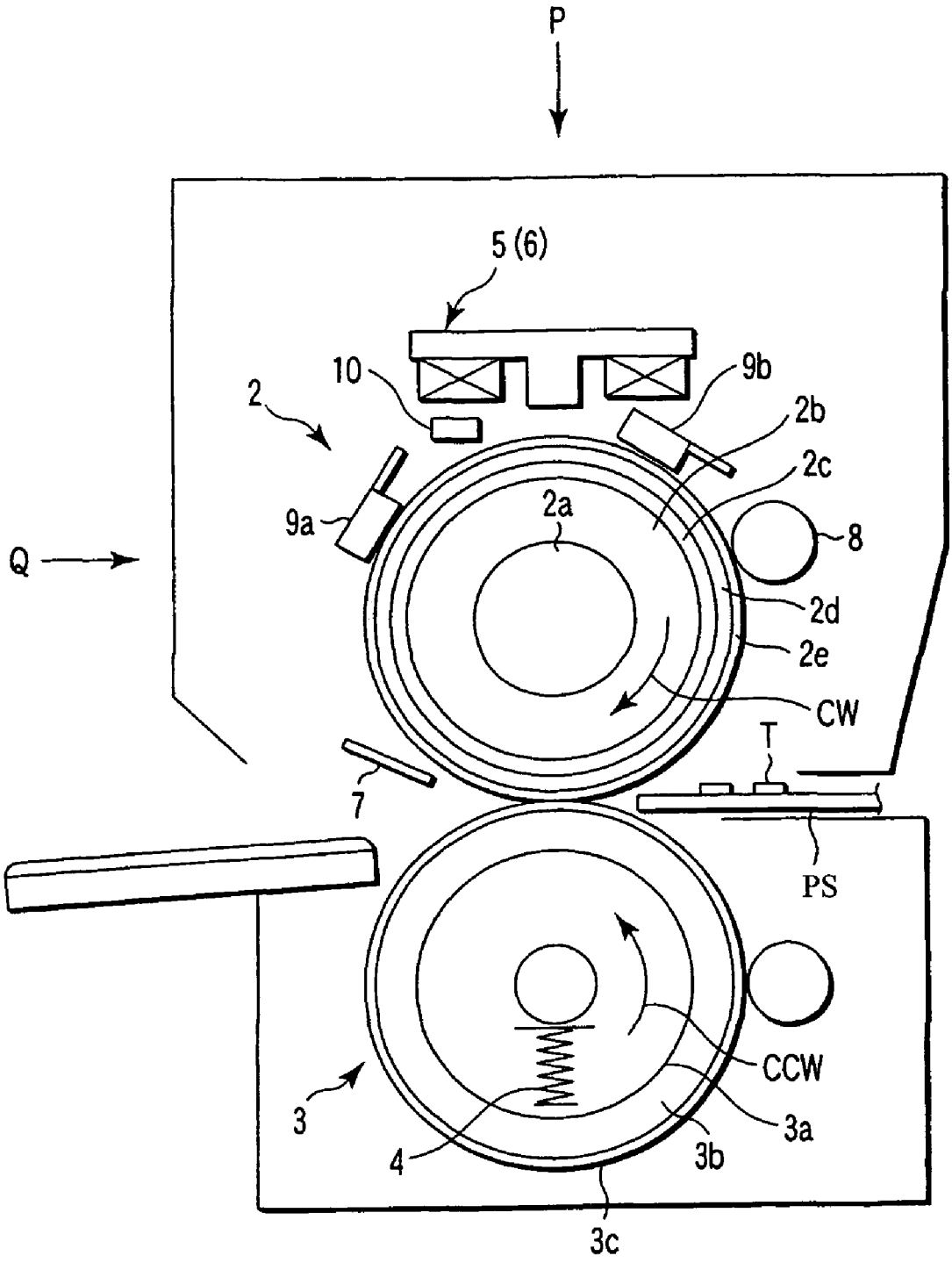
FIG. 1 is a schematic diagram explaining a fixing apparatus to which an embodiment of the present invention is applicable.

FIG. 1 shows an example of a fixing apparatus of the present invention.

As shown in FIG. 1, a fixing apparatus has a heating member (a heating roller) 2 which contacts the surface of transferred material or a paper sheet PS adhered with a toner T, and heats the toner T and paper sheet PS, and a pressing member (a pressing roller) 3 which applies a predetermined pressure to the heating roller 2.

The heating roller 2 has a core metal 2*a* or a metallic shaft (with a high rigidity) which is not deformed by a predetermine pressure, a foamed rubber layer (sponge) 2*b* which is arranged sequentially around the core metal 2*a*, a conductive metal layer 2*c*, a solid rubber layer 2*d*, and a mold lubricant layer 2*e*. It is preferable that the thickness of the foamed rubber layer (sponge) 2*b* is 5 mm thick, the conductive metal layer 2*c* is 40 μ/m, the solid rubber layer 2*d* is 200 μm, and the mold release layer 2*e* is 40 μm, respectively. The heating roller 2 is preferably 40 mm in diameter. The conductive metal layer 2*c* is made of conductive material (e.g. nickel, stainless steel, aluminum, copper, composite material of stainless steel and aluminum, or the like).

The pressing roller 3 preferably includes a core metal 3*a* or a metallic shaft (with a high rigidity) which is not deformed by a predetermined pressure, a silicone rubber 3*b* provided around the core metal 3*a* and a fluorine rubber 3*c*, and has a diameter of 40 mm.

The pressing roller 3 applies a predetermined pressure to the heating roller 2 by receiving a pressure from the pressing mechanism 4. The heating roller 2 contacting the pressing roller 3 with a certain nip width taken therebetween, is rotated in the arrow direction (clockwise or CW) by a driving motor (not shown). As the heating roller 2 is rotated, the pressing roller 3 is rotated in the arrow direction (counterclockwise or CCW).

A coil body (an induction heating mechanism) 5(6) which supplies a predetermined magnetic field to the conductive metal layer 2*c* of the heating roller 2 is arranged outside the heating roller 2 with a predetermined interval taken to the outer circumference of the roller.

The coil body 5(6) generates a predetermined magnetic field when receiving a predetermined current or voltage. By the magnetic field from the coil body 5(6), an eddy current is generated in the conductive metal layer 2*c* of the heating roller 2, and Joule heat is generated. Toner T is fused by the heat from the heating roller 2, and fixed to a paper sheet PS when a paper sheet PS adhered with the toner T passes through a contacting part (a nip) between the heating roller 2 and pressing roller 3, and receives a predetermined pressure from the pressing roller 3.

On the circumference of the heating roller 2, a separation blade 7 for separating the paper sheet PS from the heating roller 3, and a mold lubricant application unit 8 for applying a mold lubricant (e.g., silicone oil) for preventing offset to the circumference of the heating roller 2 are arranged sequentially in the rotating direction from the contacting position (nip) between the heating roller and pressing roller 3. At a predetermined position in the length direction of the heating roller 2, thermistors 9*a* and 9*b* for detecting the temperatures around the circumference of the heating roller 2 are arranged. In this embodiment, two thermistors 9*a* and 9*b* are used, but three or more can be used.

In proximity to the coil bodies 5 and 6, there is provided an abnormal temperature detection mechanism (a thermostat) 10 which cuts off the current or voltage supplied to the coils 5 and 6 when the temperature of the heating roller 2 reaches an abnormal value.

Figure 2:
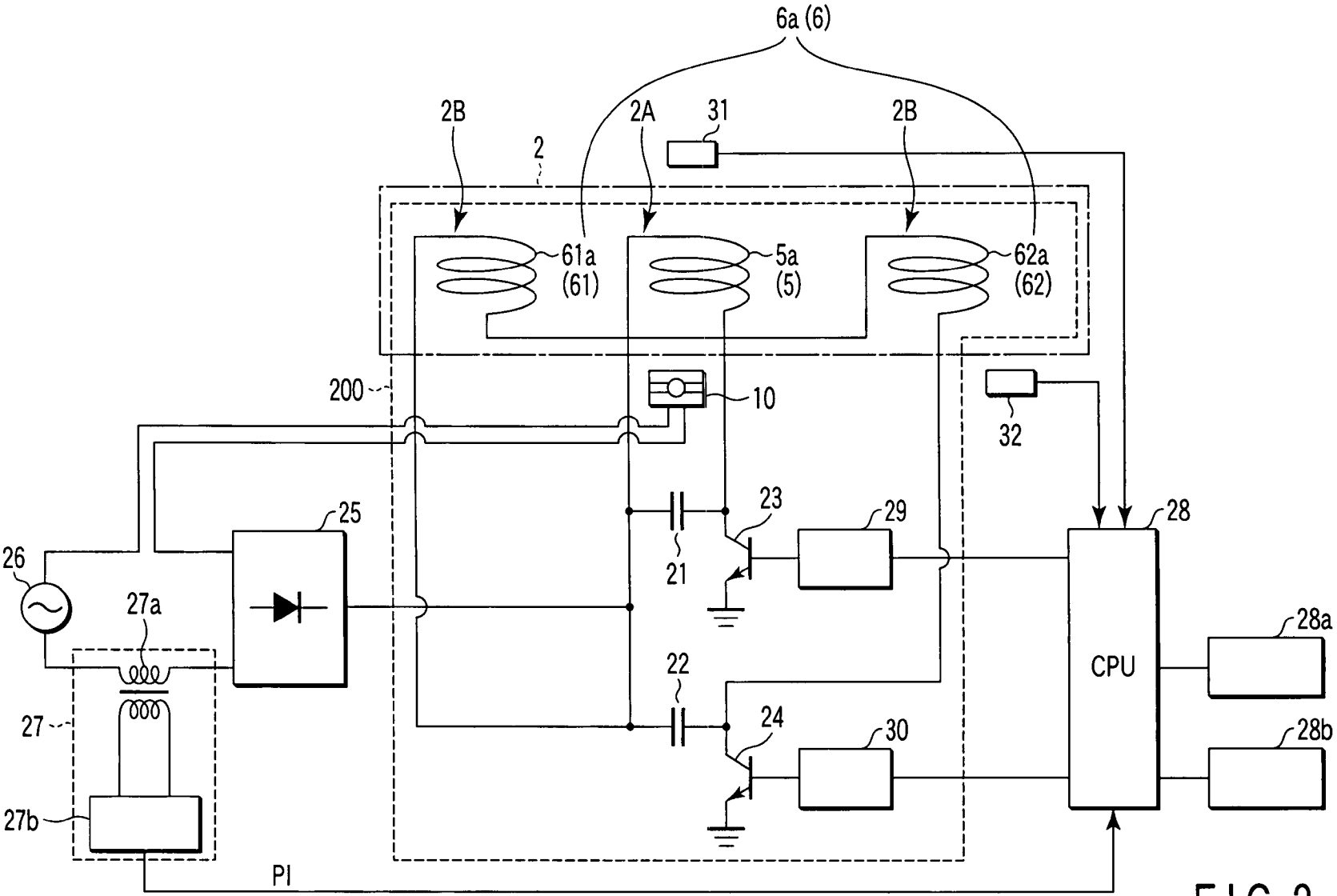
FIG. 2 is a block diagram explaining a configuration of an induction heating control circuit which is applicable to the fixing apparatus shown in FIG. 1.

FIG. 2 shows a configuration of an induction heating control circuit applicable to the fixing apparatus shown in FIG. 1.

The induction heating control circuit has a coil current control circuit 200, a rectifier circuit 25, a commercial AC current source 26, an input power monitor 27, a CPU 28 and thermistors 31 and 32. The commercial AC current source 26 is a power supply which supplies power to operate the fixing apparatus of the present invention, and is a part of the power supplied to a copier or the like provided with the fixing apparatus.

A coil current control circuit 200 includes a coil body 5 which is located at the position opposite to the central area of the heating roller 2 (the area where a paper sheet PS passes frequently), a coil body 61 which is located at the position opposite to one end of the heating roller 2 in the state aligned with the coil body 5 in the axial direction of the heating roller 2, and a coil body 62 which is aligned with the coil body 5 to face to the other end of the heating roller 2 opposite to the coil body 62. The coil body 5 includes an exciting coil 5*a*, the coil body 61 includes an exciting coil 61*a*, and the coil body 62 includes an exciting coil 62*a*. The exciting coils 61*a* and 62*a* are connected in series and electrically one coil as shown in FIG. 2, and will be explained as a coil body 6 when explaining both coil bodies 61 and 62.

A first resonance circuit includes the exciting coil 5*a* and resonance condenser 21 connected in parallel. A first inverter circuit includes the first resonance circuit and switching element 23 connected in series.

A second resonance circuit includes the exciting coil 6*a* and resonance condenser 22 connected in parallel. The exciting coil 6*a* is electrically one coil connected in series to the exciting coils 61*a* and 62*a*. A second inverter circuit includes the second resonance circuit and switching element 24 connected in series. As the switching elements 23 and 24, IGB or MOS-FET usable with high withstand voltage and large current are used.

The first and second inverter circuits are supplied with a DC current from the commercial AC current source 26 smoothed by the rectifier circuit 25. The thermostat 10 and input power monitor 27 for monitoring the input power PI or the product of the current and voltage supplied from the commercial AC power supply 26 are connected between the rectifier circuit 25 and commercial AC power supply 26.

The input power monitor 27 includes a transformer 27*a* which is connected to the commercial AC power supply 26, and an input power detection circuit 27*b* which detects the input power PI from the transformer 27*a*. The input power detection circuit 27*b* is connected to CPU 28, to which the information of the input power PI detected by the transformer 27*a* is fed back.

The CPU 28 is connected to a memory 28*a*, a timer 28*b*, and IGBT driving circuits 29 and 30. The IGBT driving circuit 29 is connected to the control terminal of the switching element 23. The IGBT driving circuit 30 is connected to the control terminal of the switching element 24. When the IGBT driving circuits 29 and 30 are operated by the CPU 28, a high-frequency current flows in the exciting coils 5*a*, 61*a* and 62*a*, generating a predetermined magnetic field. When the predetermined magnetic field is supplied to the heating roller 2, an eddy current is generated in the heating roller 2, and the exciting coil 5*a* and exciting coils 61*a*/ 62*a* generate heat in the predetermined areas 2A (the central area) and 2B (end area) of the heating roller 2, respectively. The thermistors 31 and 32 for detecting the surface temperature of the heating roller 2 are arranged in proximity to the predetermined areas 2A and 2B of the heating roller 2, respectively.

The thermistors 31 and 32 output the detected surface temperature of the heating roller 2 to the CPU 28 as a temperature detection signal (a voltage value). According to the temperature detection signal, the CPU 28 can select the IGBT driving circuits 29 and 30. For example, when the temperature of the thermistor 31 is lowered by a predetermined degree compared with the temperature of the thermistor 32, the CPU 28 drives the IGBT driving circuit 29 connected to the exciting coil 5*a* in order to heat the central area 2A of the heating roller. Conversely, when the temperature of the thermistor 32 is lowered by a predetermined degree compared with the temperature of the thermistor 31, the CPU 28 drives the IGBT driving circuit 30 connected to the exciting coils 61*a* and 62*a* in order to heat the end area 2B of the heating roller. Thus, the central area 2A and end area 2B of the heating roller 2 are heated alternately.

An induction heating control circuit applicable to the fixing apparatus of the present invention is not limited to the above-mentioned configuration. A half bridge type circuit which changes independently the frequencies of the driving voltage supplied to the switching elements 23 and 24, and a guasi-E class circuit can be used. As a driving circuit connected to the first and second inverter circuits, a circuit using PWM (pulse width modulation) can be used.

Next, explanation will be given on an example of a method of operating the fixing apparatus by referring to the circuit shown in FIG. 2.

First, explanation will be given on a method of heating alternately the central area 2A and end area 2B of the heating roller 2.

The CPU 28 instructs the IGBT driving circuits 29 and 30 to supply a current or voltage (hereinafter, described a coil output power, or a product of this current and voltage) alternately to the exciting coils 5*a* and 6*a* at a predetermined ratio (time ratio). For example, assume the time that the IGBT driving circuit 29 supplies power to the exciting coil 5*a* to be 2 and the time that the IGBT driving circuit 30 supplies power to the exciting coil 6*a* to be 1, and set larger the time ratio of heating the central part of the heating roller 2 where a paper sheet P passes more frequently. The IGBT driving circuits 29 and 30 supply a driving voltage as an ON/OFF signal alternately to the control terminals of the switching elements 23 and 24 at the timing and frequency instructed by the CPU 28.

For example, one switching element 23 supplied with the driving voltage turns on, and the other switching element 24 not supplied with the driving voltage turns off.

When the switching element 23 is turned on by the IGBT driving circuit 29, the rectifier circuit 25 supplies the exciting coil 5*a* with a predetermined power corresponding to the frequency of the driving voltage (including a high-frequency current of 20–50 kHz in this embodiment). The exciting coil 5*a* generates a magnetic field corresponding to the supplied power. When this magnetic field is generated, an eddy current flows in the predetermined area 2A of the heating roller 2 near the exciting coil 5*a*, and the heating roller 2 is heated by Joule heat. Similarly, when the switching element 24 is turned on by the driving circuit 30, the predetermined area 2B of the heating roller 2 is heated.

Since the heating roller 2 is rotated by a driving motor (not shown) when it is heated, the temperature distribution on the surface of the heating roller 2 can be made uniform in the circumferential direction of the predetermined areas 2A and 2B of the heating roller 2 near the exciting coils 5*a* and 6*a*.

Further, the surface of the heating roller 2 can be heated evenly by selectively changing the timing of supplying power to the exciting coil 5*a* located at the central area of the heating roller 2 and the exciting coil 6*a* located at the end area of the heating roller 2, according to the size of a paper sheet P passing between the heating roller 2 and pressing roller 3.

Concretely, when the longer side of A4 or A3 paper size is passed parallel to the length direction of the heating roller 2, and when a full-size paper sheet whose one side is the same length as the paper passing area in the length direction of the heating roller 2, power is supplied at almost the same ratio to the exciting coil 5*b* located at the center of the heating roller 2 and the exciting coil 6*b* located at the end.

Conversely, when passing a small size paper sheet such as a postcard, or when passing the smaller side of A4 paper size parallel to the length direction of the heating roller 2, set the ratio of power supplied to the exciting coil 5*a* located at the center larger than the power supplied to the exciting coil 6*a* located at the end.

Further, when changing the maximum value of the coil output power supplied to the exciting coils 5*a* and 6*a* (the product of the current and voltage supplied to the coils 5*a* and 6*a*) according to the operation mode, the coil output power can be changed in a range of 700 W–1500 W by controlling the frequency of the driving voltage supplied to the switching elements 23 and 24 in a range of 20–50 kHz.

Next, explanation will be given on another example of operating the fixing apparatus by referring to the circuit shown in FIG. 2.

Figure 3:
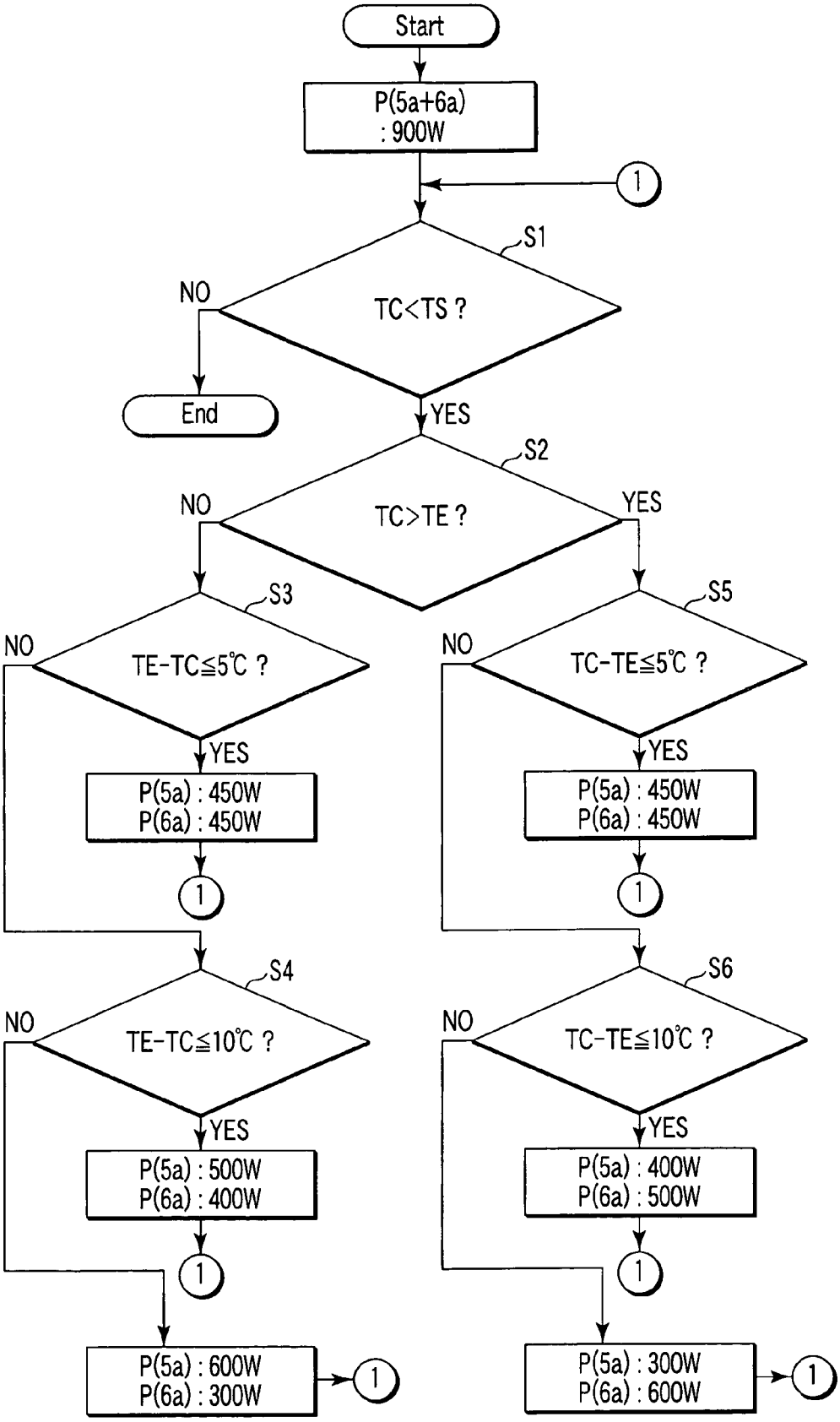
FIG. 3 is a flowchart explaining an example of a method of controlling the fixing apparatus shown in FIG. 1.

FIG. 3 is a flowchart explaining another example of the method of operating the fixing apparatus explained by using FIG. 2.

In the method of supplying power to the exciting coils 5*a* and 6*a* described above with reference to FIG. 2, while power is being supplied to one exciting coil 5*a*, power is not supplied to the other exciting coil 6*a*. Now, explanation will be given on a control method for supplying power simultaneously to both exciting coils 5*a* and 6*a*.

In the example shown in FIG. 3, the sum of the center coil output power P (5*a*) supplied from the commercial power supply 26 to the exciting coil 5*a* under the control of CPU 28 and the end coil output power P (6*a*) supplied to the exciting coil 6*a*, or the total coil output power P (5*a*+6*a*) is assumed to be 900 W. Namely, a predetermined total coil output power P (5*a*+6*a*) is assigned to the exciting coils 5*a* and 6*a* at a predetermined ratio, and supplied at the same time. In this time, the temperature TC of the predetermined area 2A of the heating roller 2 (near the exciting coil 5*a* located at the center of the heating roller 2) is detected by the thermistor 31, and compared with the standby temperature TS (e.g. 160° C.) at which toner can be fixed to a paper sheet set in the CPU 28 when passing through there (S1).

When the temperature TC detected by the thermistor 31 is lower than the standby temperature TS (S1—YES), the temperature TC detected by the thermistor 31 is further compared with the temperature TE of the predetermined position 2B of the heating roller detected by the thermistor 32 (near the exciting coil 6*a* located at the end area of the heating roller 2) (S2). When the temperature TC detected by the thermistor 31 is higher than the standby temperature TS (S1—NO), step S1 is finished.

When the temperature TE of the end area is higher than the temperature TC of the central area of the heating roller 2 (S2—NO), whether the difference between the temperatures TC and TE is less than a first predetermined temperature, 5° C. for example, is judged (S3). When the difference between the temperatures TC and TE is less than 5° C., the exciting coils 5*a* and 6*a* are supplied with power of the same value (same ratio) (S3—YES). Namely, the total coil output current 900 W is assigned at a ratio of 5:5, and power of 450 W is supplied to the exciting coil (center coil) 5*a* and exciting coil (end coil) 6*a*, respectively.

Conversely, when the difference between the temperatures TC and TE is larger than 5° C. (S3—NO), whether the difference between the temperatures TC and TE is less than a second predetermined temperature (e.g. 10° C.) is judged (S4). When the difference between the temperatures TC and TE is less than 10° C., set the ratio of power supplied to the center coil 5*a* larger than the ratio of power supplied to the end coil 6*a* (S4—YES). Namely, the total coil output current 900 W is assigned at a ratio of 5:4, and power of 500 W is supplied to the center coil 5*a* and 400 W is supplied to the end coil 6*a*.

Conversely, when the difference between the temperatures TC and TE is larger than 10° C. (S4—NO), set the ratio of power supplied to the center coil 5*a* larger than the ratio of power supplied to the end coil 6*a*. Namely, the total coil output current 900 W is assigned at a ration of 2:1, and power of 600 W is supplied to the center coil 5*a* and 300 W is supplied to the end coil 6*a*.

Returning to step S2, when the temperature TC of the central area of the heating roller 2 is higher than the temperature TE of the end area (S2—YES), whether the difference between the temperatures TC and TE is less than a first predetermined temperature (e.g. 5° C.) is judged (S5) as in step 3. When the temperature difference is less than 5° C., power of the same value is supplied to the center coil 5*a* and end coil 6*a* (S5—YES). Namely, the total coil output current 900 W is assigned at a ration of 5:5, and power of 450 W is supplied to the center coil 5*a* and end coil 6*a*.

When the temperature difference between TC and TE is larger than 5° C. (S5—NO), whether the difference between the temperatures TC and TE is less than a second predetermined temperature (e.g. 10° C.) is judged (S5) as in step 4 (S6). When the temperature difference is less than 10° C., set the ratio of power supplied to the center coil 6*a* larger than the ratio of power supplied to the end coil 5*a*. Namely, the total coil output current 900 W is assigned at a ration of 5:4, and power of 500 W is supplied to the end coil 6*a* and 400 W is supplied to the center coil 5*a*.

Conversely, when the difference between the temperatures TC and TE is larger than 10° C. (S6—NO), set the ratio of power supplied to the end coil 6*a* larger than the ratio of power supplied to the center coil 5*a*. Namely, the total coil output current 900 W is assigned at a ration of 2:1, and power of 600 W is supplied to the end coil 6*a* and 300 W is supplied to the center coil 5*a*.

As for a value of the total coil output power P (5*a*+6*a*) set in step 1, a predetermined value is selected according to the operation modes of the fixing apparatus. For example, 1200 W is set for warm-up mode, 900 W is set for paper passing mode to pass a paper sheet P between the heating roller 2 and pressing roller 3, and 700 W is set for ready mode, respectively.

Therefore, even if a temperature difference occurs in the length direction of the heating roller 2, the total power supplied to the center coil 5*a* and end coil 6*a* is not changed, and electric power can be used efficiently for induction heating.

In this control method, the electric power supplied to the coil corresponding to the lower temperature, out of TE and TC at the end area and center area of the heating roller 2, is larger than the power supplied to the coil of a higher temperature, and the power is supplied to reduce the temperature difference between the coils, maintaining constant temperature distribution in the length direction of the heating roller 2.

The ratio of power supplied to the center coil 5*a* and end coil 6*a*, and the first and second predetermined temperatures are saved in the memory 28*a* connected to the CPU 28, and set optionally.

Figure 4A:
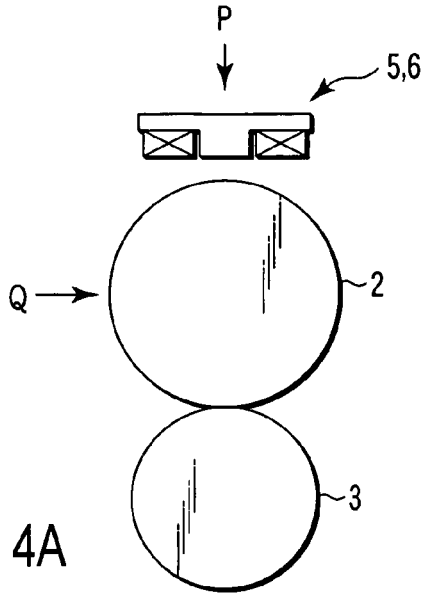
FIGS. 4A, 4B and 4C are schematic diagrams explaining another example of the induction heating mechanism shown in FIG. 2.
Figure 4B:
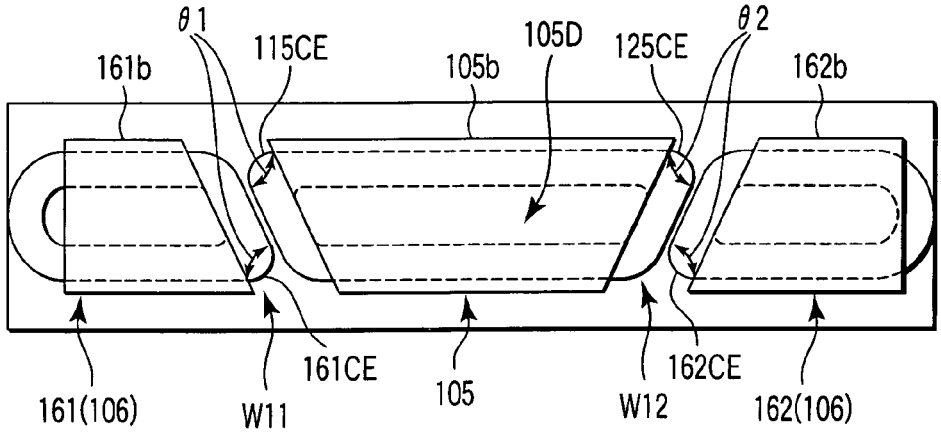
Figure 4C:
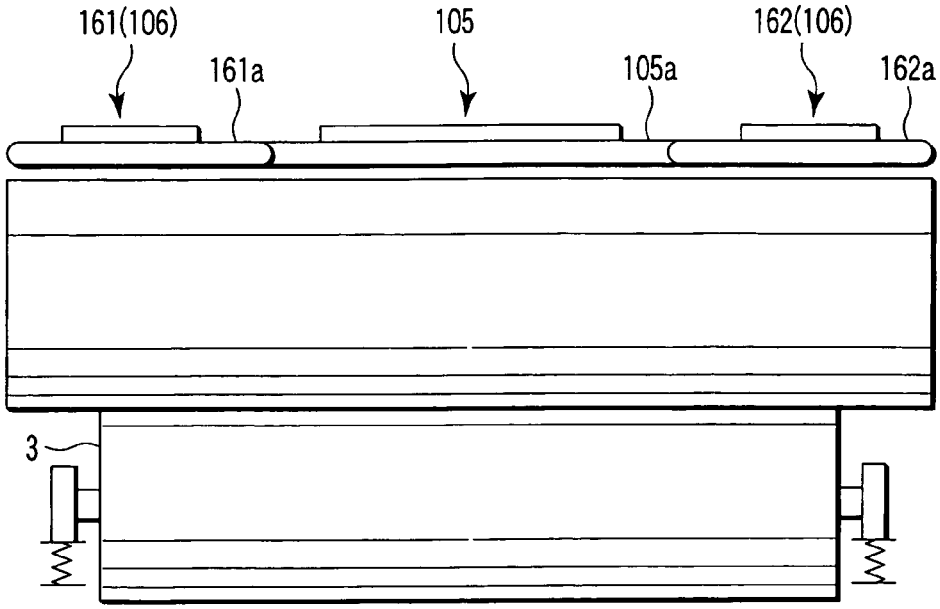

Next, explanation will be given on an example of a coil body applicable to the coil bodies 5, 61 and 62 shown in FIG. 2, with reference to FIGS. 4A–4C. FIG. 4B is a schematic perspective view seen from the arrow P direction of FIG. 4A. FIG. 4C is a schematic perspective view seen from the arrow Q direction of

FIG. 4A.

As shown in FIGS. 4B and 4C, a coil body 105 which heats the central area (the area to pass a paper sheet PS frequently) of the heating roller 2, and a coil body 106 (including 161 and 162) which heats both end areas of the heating roller 2 are arranged linearly in the axial direction outside the heating roller 2. The coil body 105 has an exciting coil 105*a*, and a magnetic core 105*b* holding the exciting coil 105*a*. The coil body 161 has an exciting coil 161*a*, and a magnetic core 161*b* holding the exciting coil 161*a*. The coil body 162 has an exciting coil 162*a*, and a magnetic core 162*b* holding the exciting coil 162*a*.

The exciting coil 105*a* has edges 115CE and 125CE formed at a predetermined angle θ1 at both ends, that is, the edge 115CE located in the side of the joint W11 of the exciting coil, and the edge 125CE located in the side of the joint W12. The exciting coil 105*a* is not limited to trapezoidal as shown in FIG. 4B. A parallelogramatic coil is permitted.

The exciting coils 161*a* and 162*a* are arranged with the centers aligned (at the same angle and phase). The exciting coil 161*a* has an edge 161CE formed at a predetermined angle θ1 in the side of the joint W11 of the exciting coil. The exciting coil 162*a* has an edge 162CE formed at a predetermined angle θ1 in the side of the joint W12 of the exciting coil.

As shown in FIG. 4B, in the state that the opposite ends (folded parts) of the exciting coils 105*a* and 161*a* are arranged in parallel, the acute angle (θ1) of the edge 115CE of the joint W11 forms an alternate angle to the acute angle (θ1) of the edge 161CE, with respect to the conductors of the exciting coils 105*a* and 161*a* extending parallel to the axial direction of the heating roller 2. Similarly, the acute angle of the edge 125CE of the joint W12 is at an alternate angle with the acute angle of the edge 162CE, with respect to the conductor extending parallel to the axial directions of the exciting coil 105*a* and 162*a*.

In other words, the exciting coil 105*a* includes the parallel wire part consisting of the wire extending parallel to the axial direction of the heating roller 2, and the folded wire part connecting one parallel wire part to the other parallel wire part arranged opposite to each other on both sides of an imaginary axis. The folded wire part crosses the parallel wire part at a predetermined angle. Namely, the folded wire part includes first and second linear parts that are the not-parallel sides of the trapezoidal exciting coil 105*a*.

The exciting coil 161*a* has a third linear part that is formed corresponding to one folded wire part (the first linear part) of the exciting coil 105 adjacent to one end. The exciting coil 162*a* has a fourth linear part that is formed corresponding to the other folded wire part (the second linear part) of the exciting coil 105*a* adjacent to one end.

Therefore, when a predetermined electric power is supplied, the exciting coils 105*a* and 161*a* can supply a magnetic field generated by both exciting coils to the area divided in the direction orthogonal to the axial direction on the outer circumference of the heating roller 2, that is, the joint W11. Similarly, when a predetermined electric power is supplied, the exciting coils 105*a* and 162*a* can supply a magnetic field generated by both exciting coils to the area divided in the direction orthogonal to the axial direction on the outer circumference of the heating roller 2, that is, the joint W12.

In other words, when a predetermined coil output power is supplied to the exciting coils 105*a*, 161*a* and 162*a*, the heating roller 2 has the joint W11 where a predetermined magnetic field is supplied from both exciting coils 105*a* and 161*a*, and the joint W12 where a predetermined magnetic field is supplied from both exciting coils 105*a* and 162*a*, in the area divided in the direction orthogonal to the axial direction.

Therefore, since the areas with magnetic fields supplied from the adjacent exciting coils are overlapped in the coil joints W11 and W12, a temperature drop can be prevented, and the temperature distribution in the length direction of the heating roller can be made uniform.

The angle θ1 is set to a determined value by evaluating the temperature based on the result of using the fixing apparatus (when passing a paper sheet P). The angle is 70° in this example.

Figure 11:
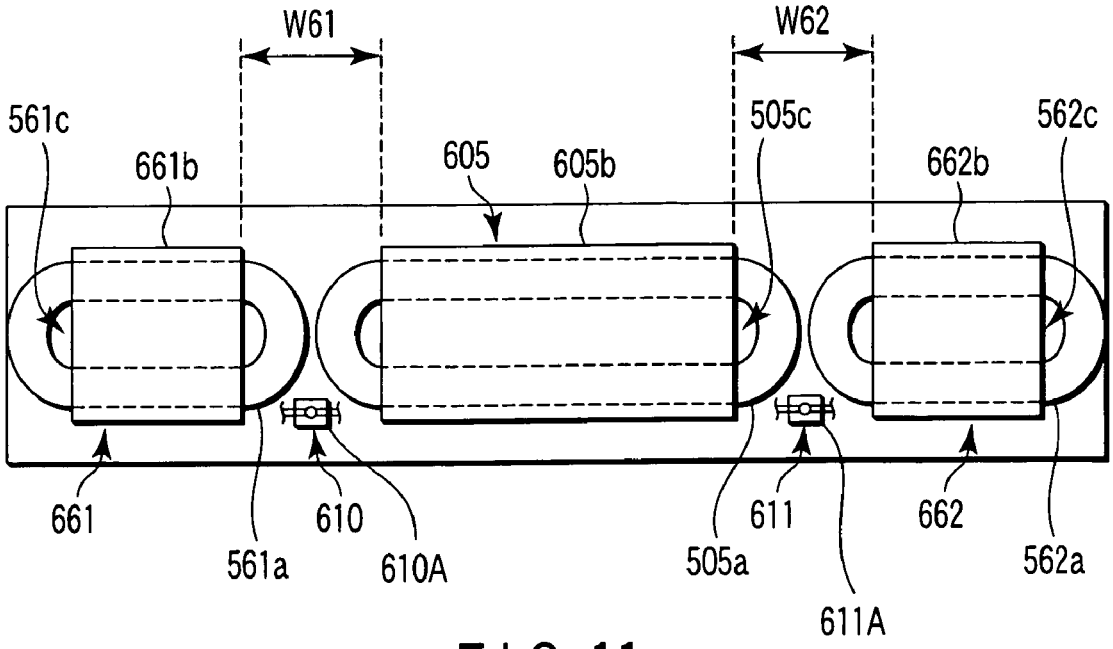
FIG. 11 is a schematic diagram explaining another example of the relationship between the induction heating mechanism and abnormal temperature detection mechanism applicable to the fixing apparatus shown in FIG. 1.

Therefore, even in the fixing apparatus having two heating rollers 2 that cannot contain an exciting coil as shown in FIG. 11, the space to arrange an exciting coil (the area occupied by the exciting coils against the heating roller 2) can be limited to a predetermined area divided in the axial direction of the heating roller 2 where the exciting coils are aligned as a single line.

Next, the magnetic cores 105*b*, 161*b* and 162*b* will be explained.

The magnetic core 105*b* is at least shaped to cover a window (space) 105D of the exciting coil 105*b*. The part covering the window 105D of the magnetic core 105*b* is thick compared with the part covering the coil conductor and fitted into the space surrounded by the coil conductor, as shown in FIG. 4A. Similarly, in the magnetic cores 161*b* and 162*b*, the space surrounded by the coil conductor or the part fitted into the window is thick compared with the part arranged on the wires of the exciting coils 161*a* and 162*a*.

By using the magnetic cores shaped as described above, the magnetic fields generated by the exciting coils 105*a*, 161*a* and 162*a* from the supplied electric power can be supplied efficiently to the heating roller 2.

Next, explanation will be given on an example of the relationship between the coil bodies 105, 161, 162 and thermostat 110 explained in FIGS. 4A–4C with reference to FIGS. 5A and 5B.

Figure 5A:
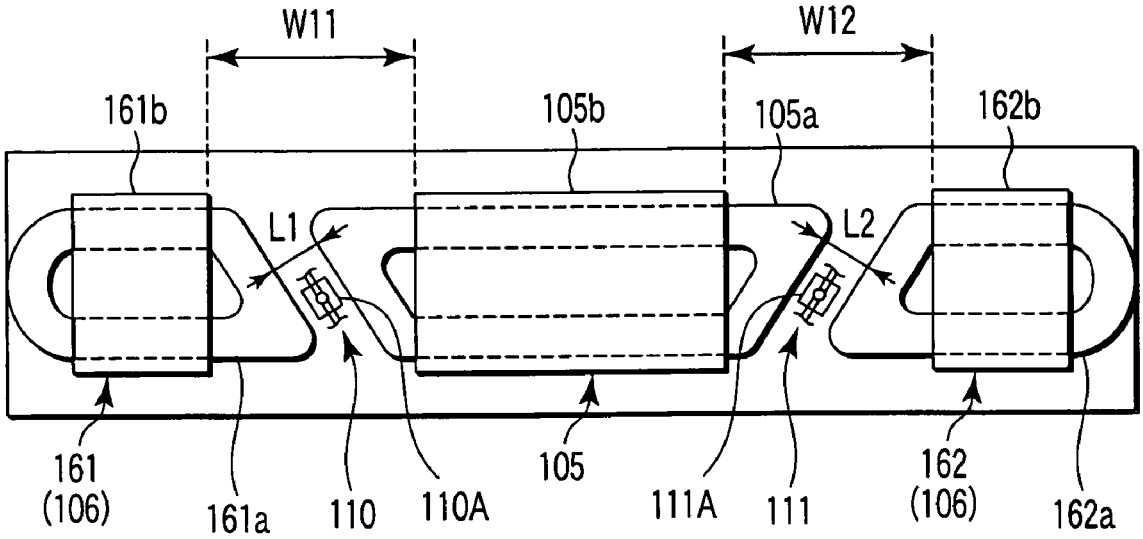
FIGS. 5A and 5B are schematic diagrams explaining examples of arrangement of an abnormal temperature detection mechanism placed close to the induction heating mechanism shown in FIGS. 4A, 4B and 4C.
Figure 5B:
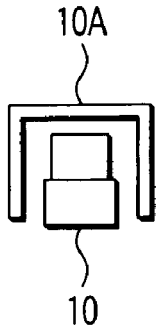

As shown in FIG. 5A, a thermostat 110 is placed between the coil bodies 105 and 161, and a thermostat 111 is placed between the coil bodies 105 and 162. The thermostats 110 and 111 are configured to detect the surface temperature of the heating roller 2, and cut off the electric power supplied to the exciting coils 105*a*, 161*a* and 162*a* when the detected temperature reaches an abnormal value.

In details, the distance between the exciting coils 161*a* and 105*a* is L1, and the distance between the exciting coils 162*a* and 105*a* is L2. The thermostats 110 and 111 are preferably arranged close to the exciting coil.

Therefore, the thermostats 110 and 111 are arranged near the area where the magnetic field between the heating roller 2 and the wire of the exciting coil 105*a* is supplied continuously, for example, and can detect the temperature of the heating roller 2 by thermal conduction with a faster response. Therefore, even if the heating roller 2 is stopped and heated locally, the thermostats can detect an abnormal temperature rise in the area where the temperature rises to the highest value.

Further, in a fixing apparatus which has two heating rollers 2 and cannot contain an exciting coil, for example, the space to place an abnormal temperature detection mechanism (the area occupied by the exciting coils arranged outside the heating roller 2) includes the area to place the exciting coils 105*a*, 161*a* and 162*a*, and the unit can be made compact.

The distance L1 and L2 is set to a value not causing a temperature difference in the axial direction of the heating roller 2. In details, the distance L1 is set to a value that the difference between the magnetic field supplied from the exciting coils 105*a*/161*a* and the magnetic field supplied from the exciting coil 105 or the center of the exciting coil 161*a* becomes minimum or zero in the joint W11 of the magnetic coils, when a predetermined electric power is supplied to the exciting coils 105*a* and 161*a*. Similarly, the distance L2 is set to a value that the difference between the magnetic field supplied from the exciting coils 105*a*/162*a* and the magnetic field supplied from the exciting coil 105 or the center of the exciting coil 162*a* becomes minimum or zero in the joint W12 of the magnetic coil, when a predetermined electric power is supplied to the exciting coils 105*a* and 162*a*.

Therefore, since the areas where the magnetic field is supplied from the adjacent exciting coils is overlapped in the coil joints W11 and W12, a temperature drop can be prevented, and the temperature distribution in the length direction of the heating roller 2 can be made uniform.

Magnetic field shielding materials 110A and 111A may be provided in the thermostats 110 and 111, respectively. The magnetic field shielding materials 110A and 111A prevent supply of the magnetic field to the thermostats 110 and 111 from the surrounding magnetic coils, for example. With the magnetic field shielding material 110A, the thermostat 110 is prevented from being influenced by the magnetic field from the exciting coil 105*a*, and a malfunction such as failure to detect a correct temperature caused by the temperature increase by induction heating (inductive current) can be prevented. The magnetic field shielding material 110A is preferably shaped to cover the surface of the thermostat 110 facing to the exciting coil, except the part where the thermostat 110 faces to the outer circumference of the heating roller 2, as shown in FIG. 5B with respect to thermostat 10 and magnetic shielding material 10A.

Figure 6A:
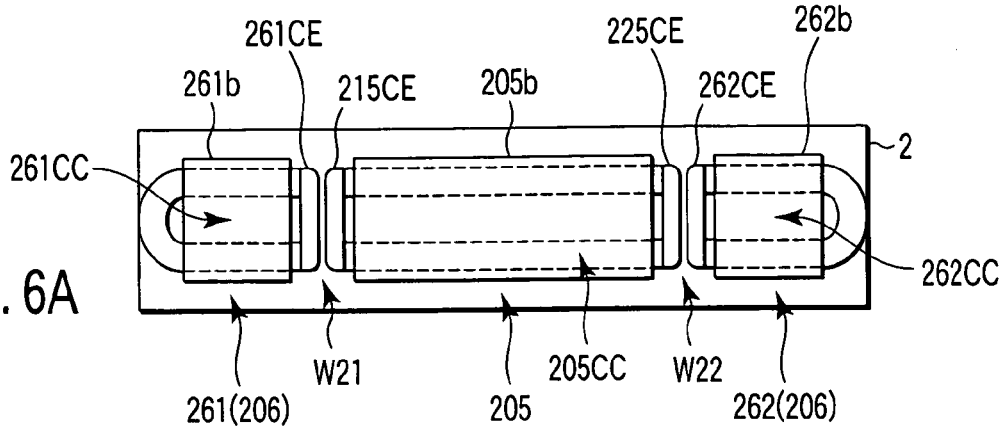
FIGS. 6A, 6B, 6C and 6D are schematic diagrams explaining other examples of the induction heating mechanism shown in FIG. 2.
Figure 6B:
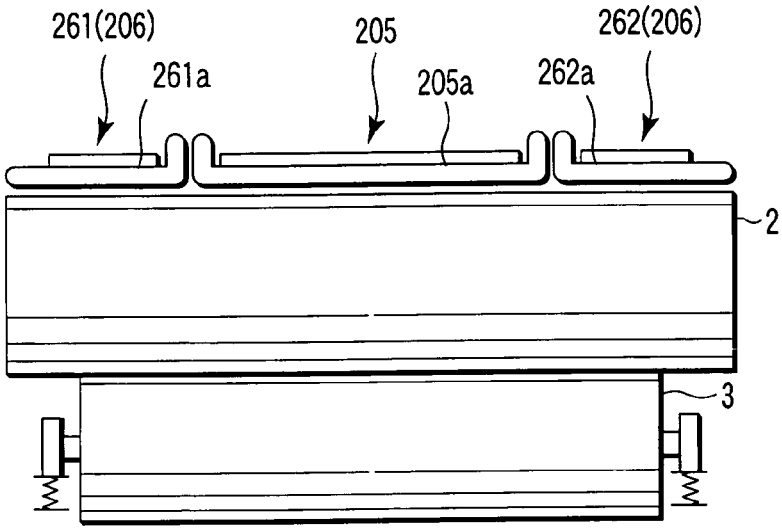
Figure 6C:
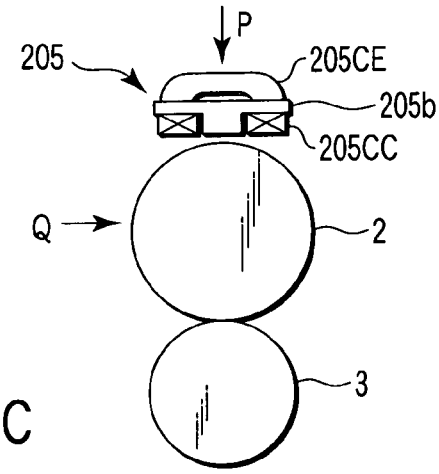

Next, explanation will be given on another example different from the coil bodies 5 and 6 shown in FIG. 2 with reference to FIGS. 6A–6D. FIG. 6A is a schematic perspective view seen from the arrow P direction of FIG. 6C. FIG. 6B is a schematic perspective view seen from the arrow Q direction of

FIG. 6C.

As shown in FIGS. 6A and 6B, a coil body 205 which heats the central area of the heating roller 2, and a coil body 206 which heats both end areas of the heating roller 2 are provided outside the heating roller 2. The coil body 206 includes a coil body 261 which heats one end of the heating roller 2, and a coil body 262 which heats the other end of the heating roller 2. The coil bodies 261 and 262 are connected in series, and formed electrically as one coil.

The coil bodies 205, 261 and 262 have exciting coils 205*a*, 261*a* and 262*a* whose at least one end is inclined to the opposite side to the heating roller 2, and magnetic cores 205*b*, 261*b* and 262*b* which hold the exciting coils 205*a*, 261*a* and 262*a*, respectively.

The exciting coils 205*a*, 261*a* and 262*a* have the largeness that the adjacent coils are overlapped in the joint of exciting coils, when they are arranged linearly outside the heating roller 2.

Thus, one ends 215CE and 261CE of the adjacent exciting coils 205*a* and 261*a* are folded not to contact each other in the folding line part located at the boundary of the central part and end part of the exciting coil, and raised 90° toward the opposite side (the magnetic core side) of the heating roller 2. Similarly, the other ends 225CE and 262CE of the adjacent exciting coils 205*a* and 262*a* are folded not to contact each other in the bending line part located at the boundary of the central part and end part of the exciting coil, and raised 90° toward the opposite side (the magnetic core side) of the heating roller 2.

In other words, the interval between the heating roller 2 and the central part of the exciting coil 205*a* is narrow, compared with the interval between the heating roller 2 and the end 215CE of the exciting coil 205*a* adjacent to the exciting coil 261*a*, and the interval between the heating roller 2 and the end 225CE of the exciting coil 205*a* adjacent to the exciting coil 262*a*. The interval between the heating roller 2 and the central part of the exciting coil 261*a* is narrow, compared with the interval between the heating roller 2 and the end 261CE of the exciting coil 261*a* adjacent to the exciting coil 205*a*. The interval between the heating roller 2 and the central part of the exciting coil 262*a* is narrow, compared with the interval between the heating roller 2 and the end 262CE of the exciting coil 262*a* adjacent to the exciting coil 205*a*.

The folding line part is preferably located on the innermost and turned wire among the wires of the exciting coil. In the folding line part, the end of the exciting coil can be inclined easily. Further, since the part not inclined or the central part of the exciting coil consisting of the wire parallel to the axial direction of the heating roller 2 is arranged with a certain interval taken to the heating roller 2, a uniform magnetic field in the axial direction of the heating roller 2 can be obtained.

The end of the exciting coil may be inclined more outside the folding line than the innermost and turned wire. This suppresses the height of the exciting coil from the outer circumference of the heating roller 2, and the unit can be made compact.

The adjacent exciting coils 205*a* and 261*a* are arranged outside the heating roller 2 close to each other, so that the ends 215CE and 261CE of the folded side do not contact each other and the coil centers are aligned (at the same angle and phase). Similarly, the adjacent exciting coils 205*a* and 262*a* are arranged outside the heating roller 2 close to each other, so that the coil centers are aligned. As the magnetic cores 205*b*, 261*b* and 262*b* of each coil body become close to one another, and the magnetic flux density (a intensity of magnetic flux) between the coils can be increased.

Figure 6D:
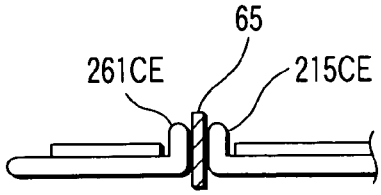

A magnetic field shielding plate 65 may be placed in the joints W21 and W22 of the exciting coil, as shown in FIG. 6D. By using the magnetic field shielding plate 65, when electric power is supplied simultaneously to all exciting coils 205*a*, 261*a* and 262*a*, a change in the magnetic field caused by the mutual induction occurring between the ends 215CE and 261CE or between the ends 225CE and 262CE of each exciting coil is prevented, and a temperature fluctuation in the axial direction of the heating roller 2 caused by the change in the magnetic field can be suppressed.

In this embodiment, by raising the coil ends (215CE, 225CE, 261CE and 262CE) where the intensity of the magnetic field generated when electric power is supplied is weak to the opposite side of the heating roller 2, the magnetic field from the coil centers (205CC, 261CC and 262CC) where the magnetic flux density is stronger can be supplied to the heating roller 2. The coil ends 215CE and 225 CE are generically referred to as 205CE in FIG. 6B. Therefore, in the heating roller 2 where the coil centers generating a uniform magnetic field are faced close to each other, the temperature distribution in the length direction becomes uniform.

Next, explanation will be given on still another example different from the coil bodies 5 and 6 shown in FIG. 2, with reference to FIGS. 7A and 7B.

Figure 7A:
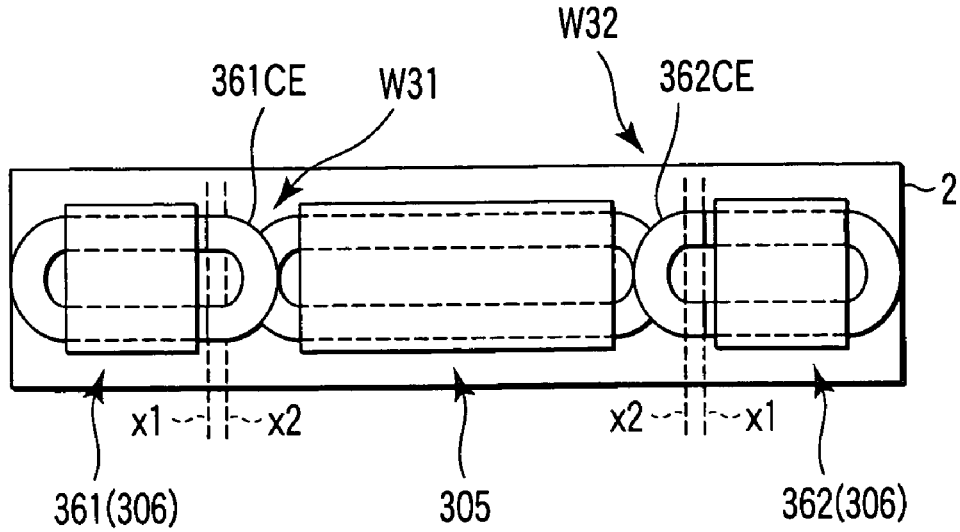
FIGS. 7A and 7B are schematic diagrams explaining still other examples of the induction heating mechanism shown in FIG. 2.
Figure 7B:
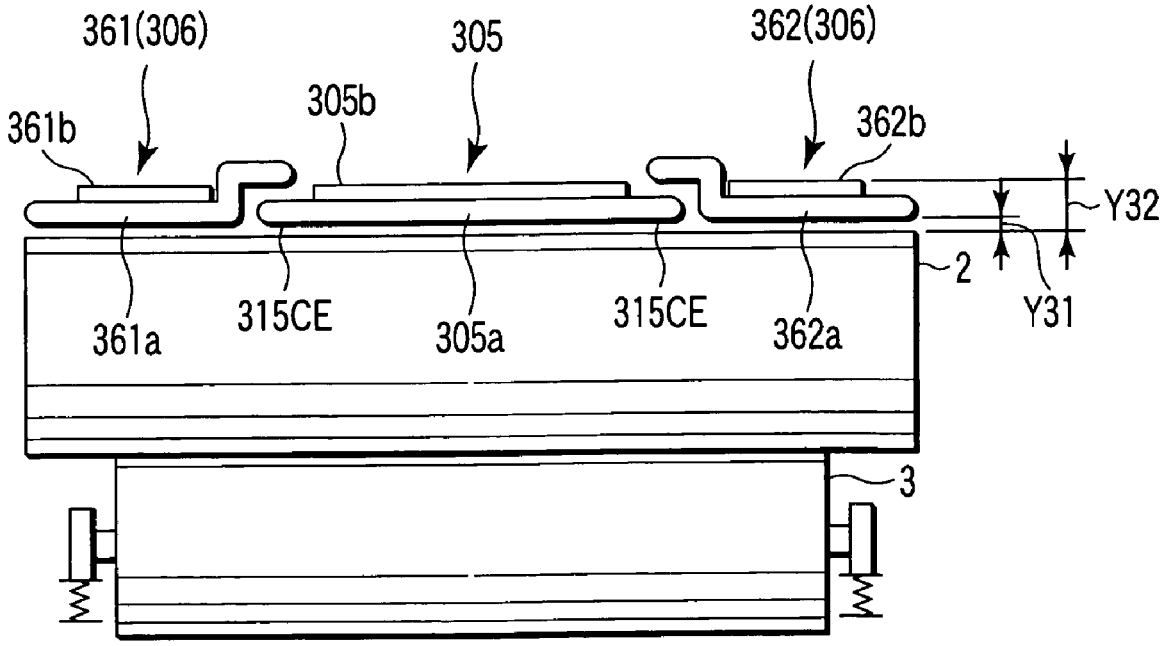

As shown in FIGS. 7A and 7B, a coil body 305 which heats the central part of the heating roller 2, and a coil body 306 which heats both ends of the heating roller 2 are provided outside the heating roller 2. The coil body 306 includes a coil body 361 which heats one end of the heating roller 2, and a coil body 362 which heats the other end of the heating roller 2. The coil bodies 361 and 362 are connected in series, and formed electrically as one coil.

The coil body 305 has an exciting coil 305*a*, and a magnetic core 305*b* for holding the exciting coil 305*a*. The coil body 361 has an exciting coil 361*a* with one end adjacent to the coil body 305 and inclined to the opposite side to the heating roller 2, and a magnetic core 361*b* for holding the exciting coil 361*a*. The coil body 362 has an exciting coil 362*a* with one end adjacent to the coil body 305 and inclined to the opposite side to the heating roller 2, and a magnetic core 362*b* for holding the exciting coil 362*a*.

In other words, the exciting coil 305*a* does not have an inclined part, and has an interval of distance Y31 to the heating roller 2 at the center and both ends. The exciting coil 361*a* has an interval of distance Y31 between the central part and the heating roller 2, and has an interval of distance Y32 between the end 361CE adjacent to the excitation coil 305*a* and the heating roller 2. The exciting coil 362*a* has an interval of distance Y31 between the central part and the heating roller 2, and has an interval of distance Y32 between the end 362CE adjacent to the exciting coil 305*a* and the heating roller 2. The distance Y31 is small compared with the distance Y32. Namely, only the ends of the exciting coils 361*a* and 362*a* are adjacent to the exciting coil 305*a* are separated from the heating roller 2, and both ends of the exciting coil 305*a* are placed between the heating roller 2 and the ends 361CE and 362CE of the exciting coils 361*a* and 362*a*.

The exciting coils 305*a*, 361*a* and 362*a* have s size such that the adjacent coils are overlapped in the joints W31 and W32 of the exciting coils, like the exciting coils 205*a*, 261*a* and 262*a*.

The exciting coils 305*a*, 361*a* and 362*a* are aligned (at the same angle and phase) outside the heating roller 2. In this time, one end 361CE of the exciting coil 361*a* is bent toward the opposite side (the magnetic core side) of the heating roller 2, not to make contact with one end 315CE of the adjacent exciting coil 305*a*. Similarly, one end 362CE of the exciting coil 362*a* is bent toward the opposite side (the magnetic core side) of the heating roller 2, not to make contact with the other end 325CE of the adjacent exciting coil 305*a*.

Namely, one end 361CE of the exciting coil 361*a* and one end 362CE of the exciting coil 362*a* are bent to the upper side in an imaginary line X1 on the paper surface (refer to FIG. 7B). Then, the front end of the exciting coil 361 is bent to the right side in an imaginary line X2 on the paper surface, and front end of the exciting coil 362 is bent to the left side in an imaginary line X2 on the paper surface. Therefore, the exciting coils 361 and 362 are overlapped in the state not contacting the exciting coil 305*a*.

Thus, on the outer circumference, the exciting coil joints W31 and W32 receives the influence of a predetermined magnetic field supplied from both adjacent exciting coils 305*a* and 261*a* (or the adjacent exciting coils 305*a* and 362*a*), in the area divided in the direction orthogonal to the axial direction.

Figure 8A:
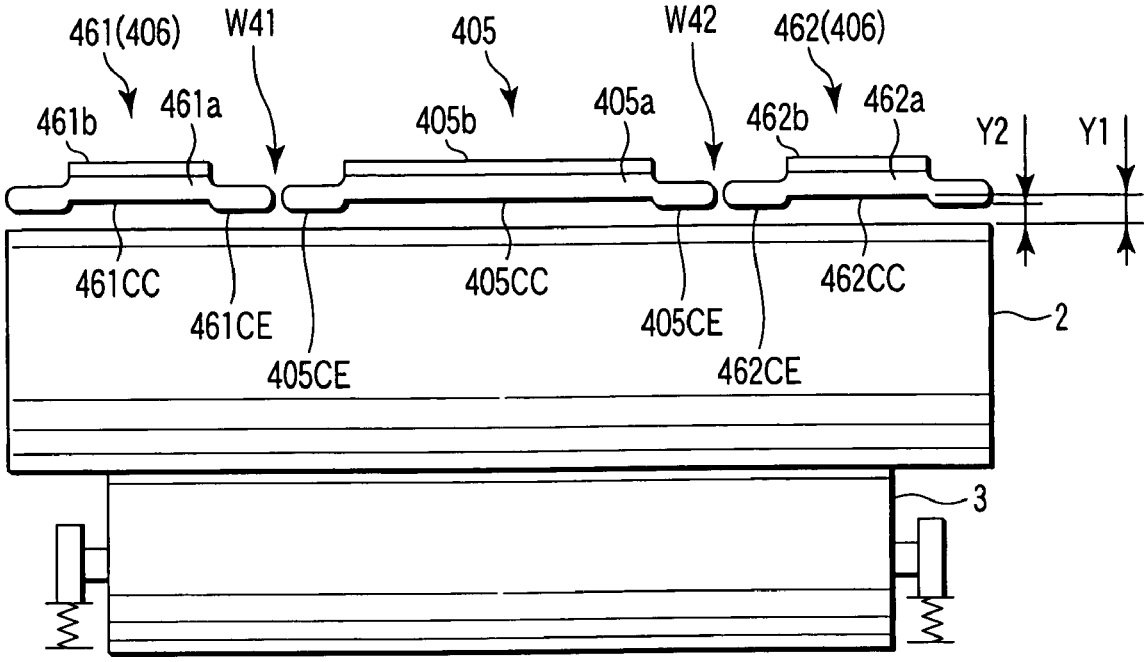
FIGS. 8A, 8B and 8C are schematic diagrams explaining still other examples of the induction heating mechanism shown in FIG. 2.
Figure 8B:
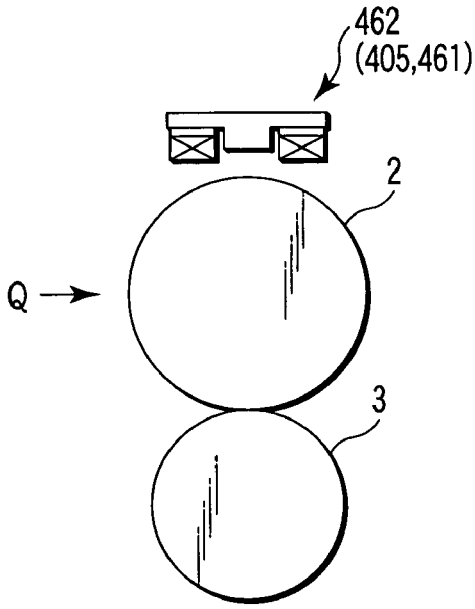

Next, explanation will be given on still another example different from the coil bodies 5 and 6 shown in FIG. 2, with reference to FIGS. 8A and 8C. FIG. 8A is a schematic perspective view seen from the arrow Q direction of FIG. 8B.

As shown in FIG. 8A, a coil body 405 which heats the central area of the heating roller 2, and a coil body 406 which heats both end areas of the heating roller 2 are provided outside the heating roller 2. The coil body 406 includes a coil body 461 which heats one end area of the heating roller 2, and a coil body 462 which heats the other end area of the heating roller 2. The coil bodies 461 and 462 are connected in series, and formed electrically as one coil.

The coil bodies 405, 461 and 462 have exciting coils 405*a*, 461*a* and 462*a* with at least one end inclined toward the heating roller 2, and magnetic cores 405*b*, 461*b* and 462*b* for holding the exciting coils 405*a*, 461*a* and 462*a*, respectively. In other words, in the exciting coil 405*a*, the interval between the coil end 405CE and the heating roller 2 is small, compared with the interval between the coil center 405CC and the heating roller 2. In the exciting coils 461*a* and 462*a*, the interval between the heating roller 2 and the coil ends 461CE and 462CE of the side adjacent to the exciting coil 405*a* is small, compared with the interval between the heating roller 2 and the coil centers 461CC and 462CC.

The exciting coils 405*a*, 461*a* and 462*a* have a size such that the adjacent coils are not overlapped, in the joints W41 and W42 of the exciting coils, when they are aligned outside the heating roller 2. One end 405CE of the adjacent exciting coil 405*a* and one end 461CE of the exciting coil 461*a* are bent toward the heating roller 2 to come closer to the outer circumference of the heating roller 2, compared with the coil center which can supply a uniform magnetic field in the length direction of the heating roller 2.

Namely, the centers 405CC, 461CC and 462CC of the respective exciting coils are arranged with an interval Y1 taken to the surface of the heating roller 2. Conversely, the ends 405CE, 461CE and 462CE of the respective exciting coils have an interval Y2 shorter than Y1 in the space to the surface of the heating roller 2.

Similarly, one end 405CE of the adjacent exciting coil 405*a* and one end 462CE of the exciting coil 462*a* are bent toward the heating roller 2 to have an interval Y2 shorter than Y1 in the space to the surface of the heating roller 2.

Thus, the ends 405CE, 461CE and 462CE of the exciting coils with the shorter distance to the heating roller 2 consumes less magnetic field supplied to the heating roller 2, compared with the centers 405CC, 461CC and 462CC with the longer distance to the heating roller 2. Therefore, the supplied magnetic field can be made uniform in the length direction of the heating roller 2, and a temperature drop in the coil joints W41 and W42 can be improved.

Further, as shown in FIG. 8A, the ends of the exciting coils 461*a* and 462*a* located at the ends of the length direction of the heating roller 2 may be bent toward the heating roller 2, like the coil ends 461CE and 462CE on the opposite side. This prevents a temperature drop caused by a heat escape at the ends of the heating roller 2.

The ends 405CE, 461CE and 462CE of the exciting coils 405*a*, 461*a* and 462*a* may be bent in the direction of the outer circumference of the heating roller 2, to have a predetermined curvature along the outer circumference of the heating roller 2, as shown in

FIG. 8C.

The bent part is located more close to the heating roller 2 than the not-bent part, and the consumption of the magnetic field supplied to the heating roller 2 can be reduced.

Figure 8C:
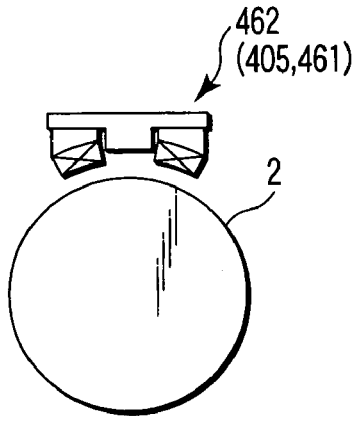

Further, the exciting coils 5*a*, 61*a* and 62*a* shown in FIG. 2, the exciting coils 105*a*, 161*a* and 162*a* shown in FIG. 4B, the exciting coils 205*a*, 261*a* and 262*a* shown in FIG. 6A, and the exciting coils 305*a*, 361*a* and 362*a* shown in FIG. 7A may be bent in the direction of the outer circumference of the heating roller 2 all over the axial direction of the heating roller 2 of the coil, to have a predetermined curvature along the outer circumference of the heating roller 2, as shown in FIG. 8C. This makes it possible to supply a magnetic field to the heating roller 2 more efficiently.

Next, explanation will be given on the arrangement of the thermostat 10 in a fixing apparatus having a plurality of exciting coils arranged linearly outside the heating roller 2, as explained above.

Figure 9A:
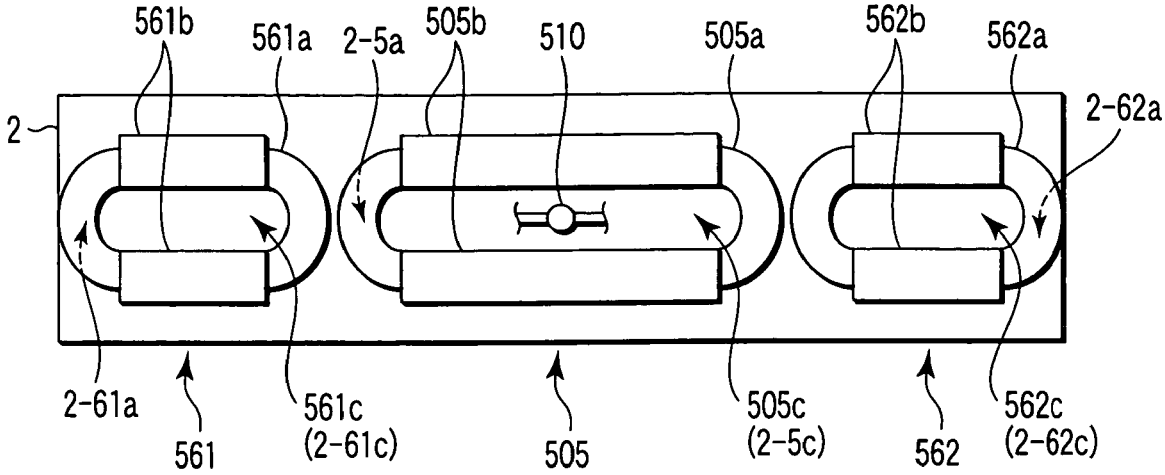
FIGS. 9A and 9B are schematic diagrams explaining an example of the relationship between the induction heating mechanism and abnormal temperature detection mechanism applicable to the fixing apparatus shown in FIG. 1.
Figure 9B:
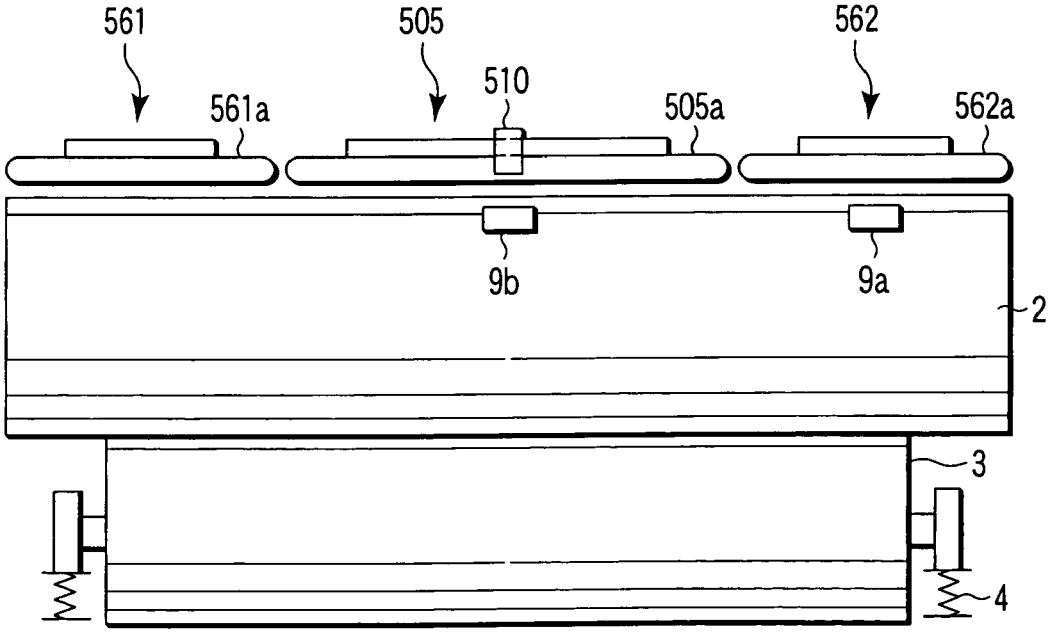

FIGS. 9A and 9B show an example of arrangement of the thermostat 10. FIG. 9A is a view seen from the arrow P direction of FIG. 1. FIG. 9B is a view seen from the arrow Q direction of FIG. 1.

As shown in FIGS. 9A and 9B, a coil body 505 is placed at the position opposite to the central area of the heating roller 2. Coil bodies 561 and 562 are placed at the position opposite to both ends of the heating roller 2, in the state arranged linearly with the coil body 505 in the axial direction of the heating roller 2. The coil bodies 561 and 562 are connected in series, and formed electrically as one coil.

The coil body 505 has an exciting coil 505*a* whose wire is wound around an imaginary axis and shaped to be a predetermined form (e.g. doughnut-shaped), and a magnetic core 505*b* placed on the wire of the exciting coil 505*a*. At the center of the exciting coil 505*a* including the imaginary axis, a space (hereinafter referred to as a window) 505*c* with no wire is formed. In the window 505*c*, the magnetic core 505 does not exist. Namely, the magnetic coil 505*a* includes one parallel wire part consisting of a parallel extending wire on which the magnetic core 505*b* is placed, and a folded wire part which connects the other parallel wire part placed opposite to one parallel wire part on the opposite side of the imaginary axis (window 505*c*).

Similarly, the coil bodies 561 and 562 have exciting coils 561*a* and 562*a* whose wire is wound around an imaginary axis and shaped to be a predetermined form. (e.g. doughnut-shaped), and magnetic cores 561*b* and 562*b* placed on the wires of the exciting coils 561*a* and 562*a*, respectively. At the centers of the exciting coils 561*a* and 562*a* including the imaginary axis, spaces (windows) 561*c* and 562*c* with no wire are formed. Namely, the magnetic coil 561*a* and 562*a* include one parallel wire part consisting of a parallel extending wire on which the magnetic cores 561*b* and 562*b* are placed, and a folded wire part which connects the other parallel wire part placed opposite to one parallel wire part on the other side of the imaginary axis (windows 561*c* and 562*c*). The magnetic cores 561*b* and 562*b* can be arranged on the parallel wire part except the windows 561*c* and 562*c*, like the magnetic core 505*b*.

As a wire of the exciting coils 505*a*, 561*a* and 562*a*, use a litz wire with insulated surface and made by binding a plurality of wires. The exciting coils 505*a*, 561*a* and 562*a* formed by the litz wire can generate a magnetic field effectively even if an alternating current is supplied. This embodiment uses a litz wire insulated by using heat-resistant polyamide and formed by binding 16 copper wires of 0.5 mm in diameter.

The number of turns of the wires of the exciting coils 505*a*, 561*a* and 562*a* can be reduced by providing magnetic cores 505*b*, 561*b* and 562*b*. The coil bodies 505, 561 and 562 formed as explained above can generate a magnetic flux intensively and heat locally a predetermined area of the heating roller 2.

The exciting coils 505*a*, 561*a* and 562*a* are arranged so that the imaginary axes are crossed vertically to the outer circumference of the heating roller 2. On the outer circumference of the heating roller 2, there are areas 2-5*a*, 2-61*a* and 2-62*a* opposite to the exciting coils 505*a*, 561*a* and 562*a* (hereinafter, referred to as a coil area), and areas 2-5*c*, 2-61*c* and 2-62*c* (hereinafter, referred to as a window area) corresponding to the windows 505*c*, 561*c*, and 562*c* with no wires and surrounded by wires. Therefore, when viewing the heating roller from the direction shown in FIG. 9A, no wires are arranged on the window areas 2-5*c*, 2-61*c* and 2-62*c*, and the surface of the heating roller 2 is seen.

In the window area 2-5*c*, an abnormal temperature detection mechanism (a thermostat) 510 is provided not contacting the heating roller 2, which detects the temperature of the heating roller 2, and when the detected temperature reaches an abnormal value, cuts off the power supplied to the exciting coils 505*a*, 561*a* and 562*a*. The abnormal temperature is a temperature higher than a temperature range demanded for fusing (a normal temperature), and is defined as an upper limit temperature at which other members mounted in the fixing apparatus malfunction, or the heating roller 2 and pressing roller 3 are stopped, and a current is abnormally and continuously supplied to the exciting coil.

Therefore, the thermostat 510 can detect the heat generated from the window area 2-5*c* of the heating roller 2 heated by the magnetic field supplied from the surrounding exciting coil 505*a*. The heat of the coil area 2-5*a* generated by the magnetic field supplied from the exciting coil 505*a* is transmitted to the window area 2-5*c*. Thus, even if the heating roller 2 is stopped, and the coil area 2-5*a* is locally heated to an abnormal temperature, the thermostat can detect the temperature close to the value in the coil area 2-5*a* where the temperature rises to the highest.

When detecting the abnormal temperature, the thermostat 510 cuts off the power supplied to the exciting coils 505*a*, 561*a* and 562*a*.

Figure 10:
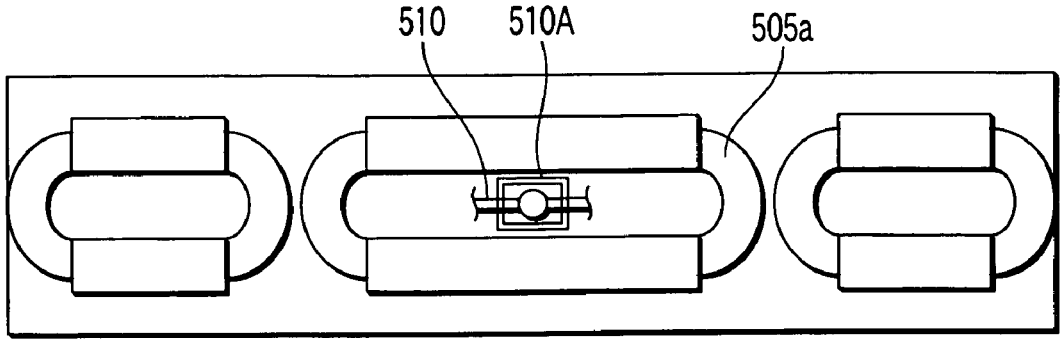
FIG. 10 is a schematic diagram explaining an example of the abnormal temperature mechanism shown in FIGS. 9A and 9B.

Further, as shown in FIG. 10, the thermostat 510 may have a magnetic field shielding material 510A to prevent supply of a magnetic field from the surrounding exciting coil 505*a*. With the magnetic field shielding material 510A, for example, the thermostat 510 is prevented from being influenced by the magnetic field from the exciting coil 505*a*, and a malfunction such as failure to detect a correct temperature caused by the temperature increase by induction heating (inductive current) can be prevented.

By placing the thermostat 510 in the coil window, the space for the abnormal temperature detection mechanism is shared by the exciting coil, and the space around the outside of the heating roller 2 can be used effectively.

In the example shown in FIGS. 9A, 9B and 10, the thermostat 510 is placed in the window 505*c* of the exciting coil 505*a*, but the present invention is not limited to this configuration. It is permitted to place the thermostat in one of the window 561*c* of the exciting coil 561*a* and window 562*c* of the exciting coil 562*a*. It is also permitted to place two thermostats in the windows 505*c* and 561*c* or the windows 505*c* and 562*c*.

Next, explanation will be give on an example of different arrangement of the thermostat 10. FIG. 11 is a view seen from the arrow P direction of FIG. 1. Detailed explanation of the same configurations as those shown in FIGS. 9A and 9B is omitted.

As shown in FIG. 11, a coil body 605 which heats the central area of the heating roller 2, and coil bodies 661 and 662 which heat both end areas of the heating roller 2 are arranged linearly in the axial direction outside the heating roller 2.

The coil body 605 has an exciting coil 505*a* whose wire is wound around an imaginary axis and shaped to be a predetermined form, and a magnetic core 605*b* which is placed on the wire of the exciting coil 505*a* and covers the window 505*c*.

Similarly, the coil bodies 661 and 662 have exciting coils 561*a* and 562*a* whose wire is wound around an imaginary axis and shaped to be a predetermined form, and magnetic cores 661*b* and 662*b* which are placed on the wires of the exciting coils 561*a* and 562*a*, and cover the windows 561*c* and 562*c* respectively.

When the imaginary axes of the exciting coils 505*a*, 561*a* and 562*a* are arranged to cross vertically to the outer circumference of the heating roller 2, an area through which the surface of the heating roller 2 is seen is formed in a predetermined area of the joint area W61 between the exciting coils 505*a* and 561*a*. At a predetermined position of the joint area W61, a thermostat 610 is placed, which detects the temperature of the heating roller 2 and cuts off the power supplied to the exciting coils 505*a*, 561*a* and 562*a* when the detected temperature reaches an abnormal value.

Similarly, an area through which the surface of the heating roller 2 is seen is formed in the joint area W62 between the exciting coils 505*a* and 562*a*. A thermostat 611 can be placed at a predetermined position in the joint area W62. The thermostats 610 and 611 are preferably placed close to the exciting coil.

Therefore, the thermostats 610 and 611 can detect the temperature of the heating roller 2 by thermal conduction at a faster response speed. Because the thermostats 610 and 611 are placed in proximity to the area where the magnetic field between the heating roller 2 and the wire of the exciting coil 505*a* is continuously supplied, and an appropriate response speed is ensured. Therefore, even if the heating roller 2 is stopped and locally heated, the thermostat can detect an abnormal temperature rise in the area of the outer circumference of the heating roller 2 where the temperature rises to the highest.

By providing two thermostats 610 and 611, even if one of them fails and does not function, the other detects an abnormal temperature. Of course, even only one thermostat can detect an abnormal temperature rise in the area of the outer circumference of the heating roller 2 where the temperature rises to the highest.

It is also possible to provide a magnetic field shielding material 610A in the thermostat 610 to prevent supply of magnetic field from the exciting coils 505*a* and 561*a*, and to provide a magnetic field shielding material 611A in the thermostat 611 to prevent supply of magnetic field from the exciting coils 505*a* and 562*a*.

Figure 12A:
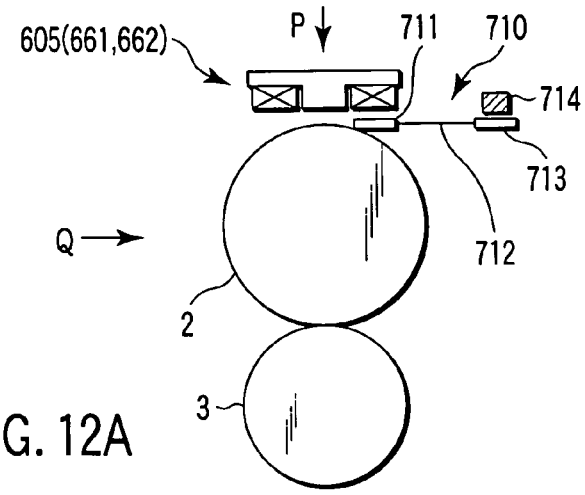
FIGS. 12A, 12B and 12C are schematic diagrams explaining still other examples of relationship between the induction heating mechanism and abnormal temperature detection mechanism applicable to the fixing apparatus shown in FIG. 1.
Figure 12B:
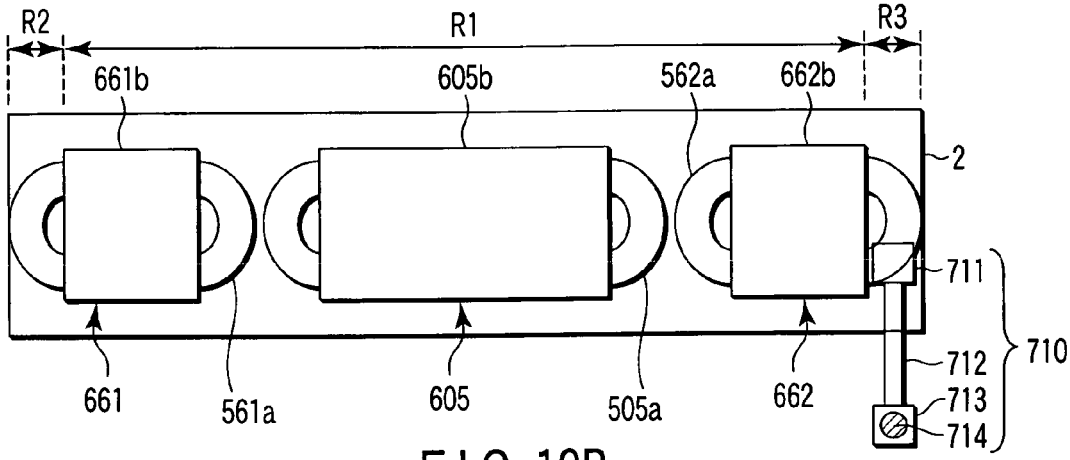
Figure 12C:
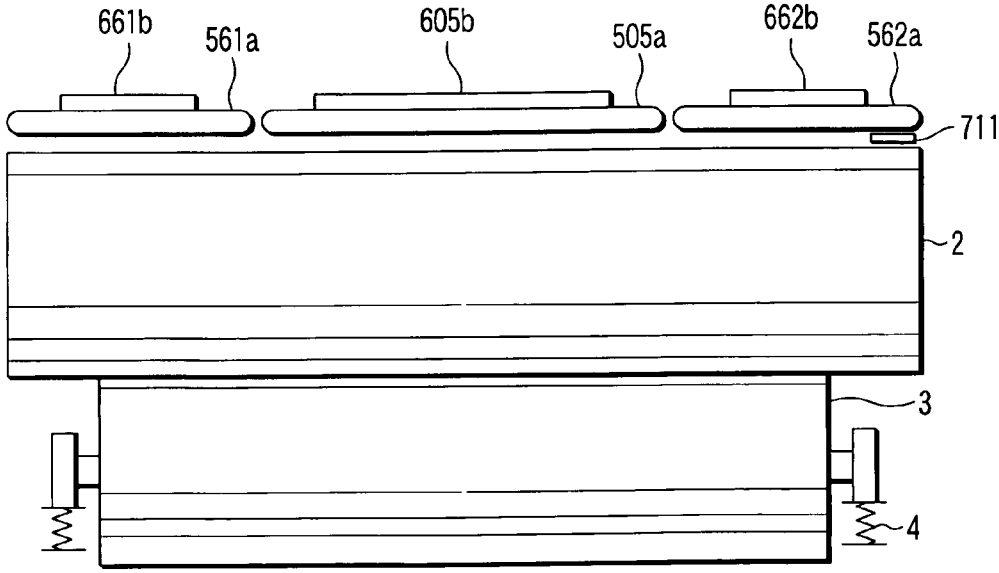

FIGS. 12A, 12B and 12C show still another example of the thermostat 10. FIG. 12A is a schematic diagram showing the relationship between the heating roller 2 and abnormal temperature detection mechanism. FIG. 12B is a view seen from the arrow P direction of FIG. 12A. FIG. 12C is a view seen from the arrow Q direction of FIG. 12A. Detailed explanation of the same configurations as those shown in FIGS. 9A and 9B is omitted.

As shown in FIG. 12A, a coil body 605 which heats the central area of the heating roller 2, and coil bodies 661 and 662 which heat both end areas of the heating roller 2 are provided outside the heating roller 2.

The coil body 661 which heats one end area of the heating roller 2 is arranged opposite to a part of the area R1 where a paper sheet PS passes in the length direction of the heating roller 2, and a part of area R2 (area not to pass paper) where a paper sheet PS is not passed in the length direction of the heating roller 2. The coil body 662 which heats the other end area is arranged opposite to a part of the area R1 where a paper sheet PS passes in the length direction of the heating roller 2, and a part of the area R3 (area not to pass paper) where a paper sheet PS is not passed in the length direction of the heating roller 2.

The coil body 605 has an exciting coil 505*a* and a magnetic core 605*b*. The coil bodies 661 and 662 have exciting coils 561*a*/562*a* and magnetic cores 661*b*/662*b*, respectively.

Between the exciting coil 562*a* and the area R3 not to pass paper, a part of a heat pipe type abnormal temperature detection mechanism 710 is provided closely or contacted.

The abnormal temperature detection mechanism 710 has a first conductive member 711 which is provided close to or contacting the outer circumference of the heating roller 2 between the outer circumference of the heating roller 2 and the wire of the exciting coil 562*a*, a heat pipe 712 which transmits the heat from the first conductive member 711 to a position separated from the heating roller 2, a second conductive member 713 which conducts the heat from the heat pipe 712, and an abnormal temperature detector 714 which detects the temperature of the second conductive member 713 and cuts off the power supplied to the exciting coils 505*a*, 561*a* and 562*a* when the detected temperature reaches an abnormal value.

The first conductive member 711 is composed of material with a high thermal conductivity (e.g. material including copper, aluminum, silver or the like). The first conductive member 711 may include material that is hard to heat by the induction heating to heat the heating roller 2, or material having deep penetration depth of the magnetic flux generated from the exciting coil used for the induction heating. Therefore, most magnetic flux from the excited coil passes through the first conductive member 711, and the first conductive member 711 is not heated.

The second conductive member 713 is composed of material (e.g. materials including copper, aluminum, silver or the like) with a very high thermal conductivity and not heated by the magnetic field supplied from the exciting coil 562*a*.

The first conductive member 711, heat pipe 712 and second conductive member 713 can be made in one body.

When a predetermined electric power is supplied to the exciting coils 505*a*, 561*a* and 562*a* and the heating roller 2 is heated, the first conductive member 711 is heated to the temperature almost equal to the surface temperature of the heating roller 2 by the radiation heat from the heating roller 2. The second conductive member 713 on which the abnormal temperature detector 714 is placed at a predetermined placeable position, is held at the temperature of the first conductive member 711 by the thermal conduction using the heat pipe 712. Thus, the abnormal temperature detector 714 supplied with the radiation heat from the second conductive member 713 can detect the temperature of the first conductive member 711, that is, the temperature almost equal to the outer circumference of the heating roller 2 even at a position separated from the heating roller 2.

Therefore, the abnormal temperature detector 714 is not necessarily placed near the heating roller 2, and the mounting positions of the abnormal temperature detector 714 and exciting coils 505*a*, 561*a* and 562*a* are not limited.

When the heating roller 2 is heated to an abnormal value, the conductive member 711 placed between the heating roller 2 and exciting coil 562*a* can detect the temperature of the heating roller 2 at a faster response speed. This temperature is conducted through the heat pipe 712 and second conductive member 713, and detected by the abnormal temperature detector 714. The abnormal temperature detector 714 detects the abnormal temperature, and cuts off the power supplied to the exciting coils 505*a*, 561*a* and 562*a*.

Therefore, even if the heating roller 2 is stopped, the abnormal temperature can detect the temperature almost equal to the temperature of the first conductive member 711 located close to the heating roller 2 at a fast response speed, and the heating roller is prevented from being locally heated.

By contacting the first conductive member 711 with the heating roller 2, the first conductive member 711 can detect the surface temperature of the heating roller 2 at a faster response speed.

The mounting position of the first conductive member 711 is not limited to the place described above. It may be placed in the area R1 where a paper sheet PS passes. In this case, it is preferable not to bring the first conductive member 711 into contact with the outer circumference of the heating roller 2.

When the response speed of the abnormal temperature detector 714 is delayed caused by a delay in the thermal conduction, set a temperature lower than the abnormal temperature of the heating roller 2 as an abnormal temperature at which the abnormal temperature detector 714 cuts off the power supplied to the exciting coils 505*a*, 561*a* and 562*a* when the heating roller 2 reaches the abnormal temperature.

Next, explanation will be given on another example of the fixing apparatus shown in FIG. 1.

Figure 13A:
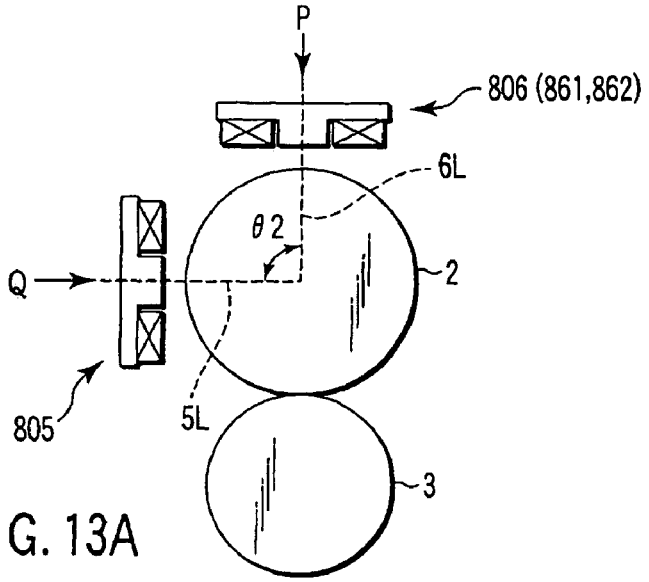
FIGS. 13A, 13B and 13C are schematic diagrams explaining another example of the induction heating mechanism shown in FIG. 2.
Figure 13B:
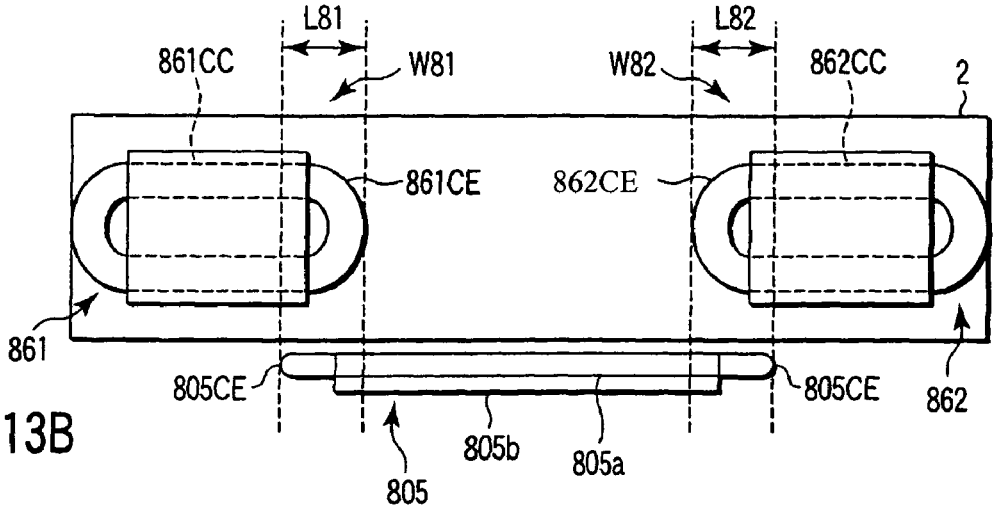
Figure 13C:
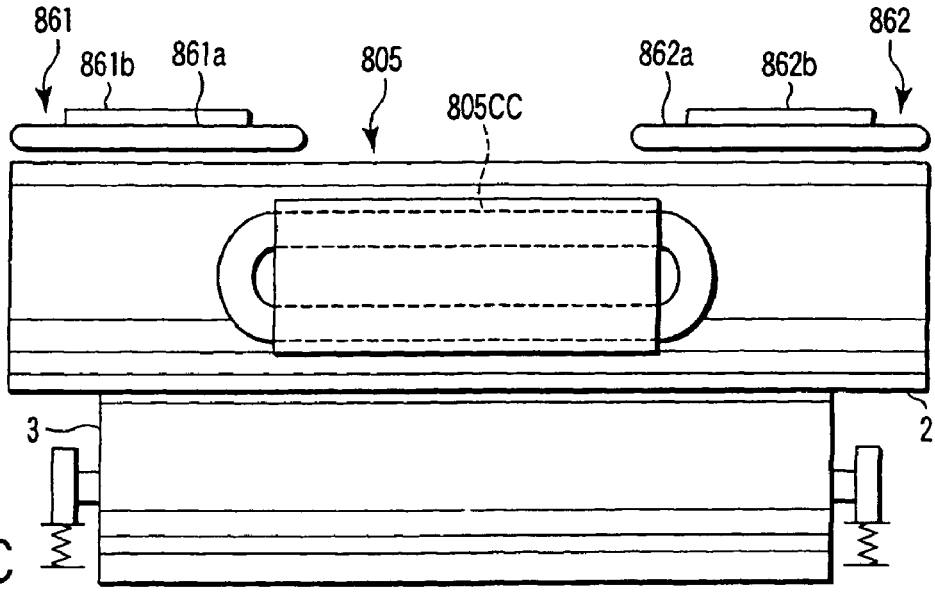

The fixing apparatus shown in FIG. 13A has coil bodies 805 and 806 different from those of the fixing apparatus shown in FIG. 1. FIG. 13B is a schematic perspective view seen from the arrow P direction of FIG. 13A. FIG. 13C is a schematic perspective view seen from the arrow Q direction of FIG. 13A.

As shown in FIGS. 13B and 13C, the coil body 805 is placed at the position opposite to the central area of the heating roller 2, and the coil body 806 is placed at the position opposite to both end areas of the heating roller 2. The coil body 806 includes a coil body 861 located at one end of the heating roller 2, and a coil body 862 located at the other end of the heating roller 2. The coil bodies 861 and 862 are connected in series, and formed electrically as one coil.

The coil body 805 is placed outside the heating roller 2 at the angle and phase different from those of the adjacent coil bodies 861 and 862. The coil bodies 805, 861 and 862 placed with different angles and phases show the state that the angle θ2 formed by virtual lines 5L and 6L which connect the axis of the heating roller 2 to the centers of the coil bodies 805, 861 and 862 is larger than 0° in the state viewed from the axial direction of the heating roller 2, as shown in FIG. 13A. FIG. 13A shows the state that the angle θ2 is 90°. The angle θ2 may be a range where the coil bodies 805, 861 and 862 do not contact each other.

The coil body 805 has an exciting coil 805*a*, and a magnetic core 805*b* for holding the exciting coil 805*a*. The coil bodies 861 and 862 have exciting coils 861*a* and 862*a*, and magnetic cores 861*b* and 862*b* for holding the exciting coils 861*a* and 862*a*, respectively. The number of turns of the wires of the exciting coils 805*a*, 861*a* and 862*a* can be reduced by providing magnetic cores 805*b*, 861*b* and 862*b*. The coil bodies 805, 861 and 862 whose wires are wound around an imaginary axis and shaped to be a predetermined form (e.g. doughnut-shaped) as sown in FIG. 13B can heat locally a predetermined area of the heating roller 2 by the magnetic flux generated intensively.

The exciting coils 805*a*, 861*a* and 862*a* have a size such that the adjacent coils are overlapped in the joints W81 and W82 of exciting coils, when they are arranged linearly outside the heating roller 2. The exciting coils 861*a* and 862*a* are arranged so that the centers of the coils are aligned outside the heating roller (at the same angle and phase), and the exciting coil 805*a* is arranged at a different angle and phase so that the end part 805CE at both ends is not overlapped with the end parts 861CE and 862CE of the exciting coils 861*a* and 862*a*.

Therefore, the heating roller 2 has the joint W81 of the exciting coils where a predetermined magnetic field is supplied from both exciting coils 805*a* and 861*a* and the joint W82 of the exciting coils where a predetermined magnetic field is supplied from both exciting coils 805*a* and 862*a*, in the area divided in the direction orthogonal to the axial direction, when an electric power is supplied to the exciting coils 805*a*, 861*a* and 862*a*.

The size of the coil bodies 805, 861 and 862 is set to a predetermined value by evaluating the temperature based on the result of using the fixing apparatus (when passing a paper sheet PS). In this example, when the coils are aligned outside the heating roller 2, the lengths L81 and L82 where the adjacent coils are overlapped are 10 mm, respectively.

Therefore, even if the conventional doughnut-shaped coil is used as an excited mechanism, a temperature drop in the joints W81 and W82 of the coils can be prevented.

As seen from FIGS. 13B and 13C, in this embodiment, the coils 805*a*, 861*a* and 862*a* include the center parts 805CC, 861CC and 862CC composed of the electric wire wound flat along the outer circumference of the heating roller 2, and the end parts 805CE, 861CE and 862CE composed of the electric wire bent outward with an equally distributed curvature. This improves a drawback that while the center part of the coil can supply the heating roller 2 with a magnetic field of a predetermined direction, the direction of the magnetic field supplied is not constant at the end part of the coil, and the magnetic flux density is uneven and the surface temperature of the heating roller 2 is uneven.

Figure 14A:
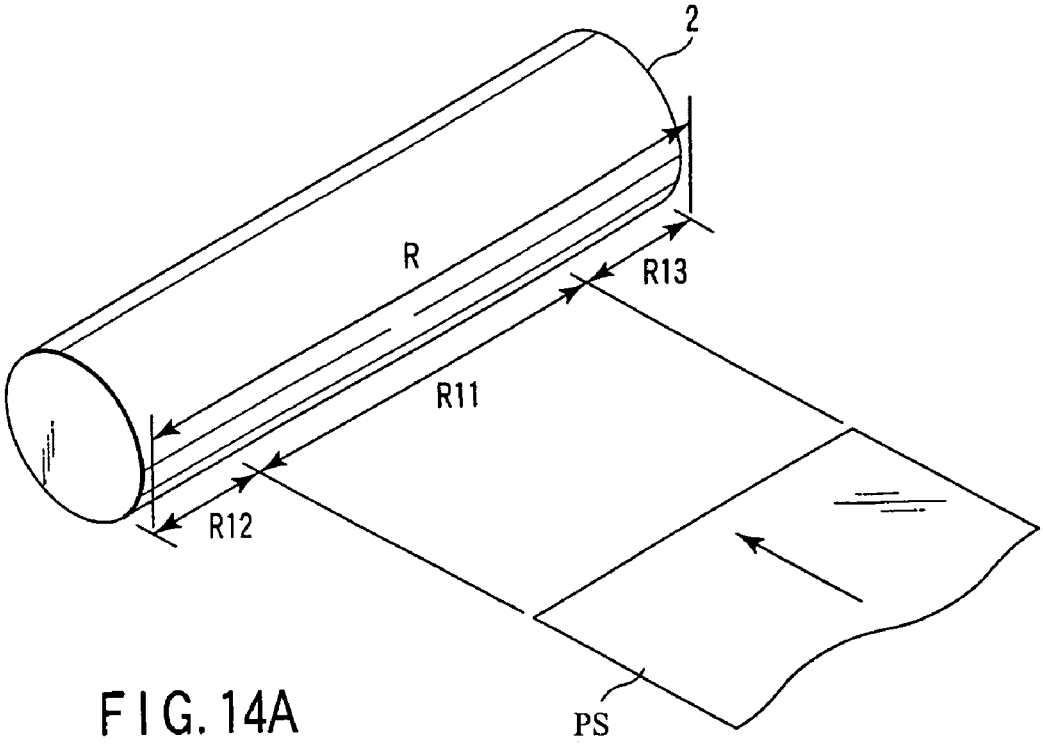
FIGS. 14A and 14B are perspective views explaining types of paper sheet passing applicable to the fixing apparatus of the present invention.

The embodiment explained above explains a fixing apparatus of the type that the area R11 to pass the center of paper in the area R of the heating roller 2 to which can a paper sheet is set at the center of the heating roller, and marginal areas R12 and R13 are set on both sides of the area R11, as shown in FIG. 14A. The area R11 is determined according to the shorter side length of A4 paper and small size paper such as a postcard, and is the area where a paper sheet passes frequently in the heating roller 2. The marginal areas R12 and R13 are the areas to pass large size paper such as A4 and A3, where a paper sheet passes less frequent than the area R11.

Figure 14B:
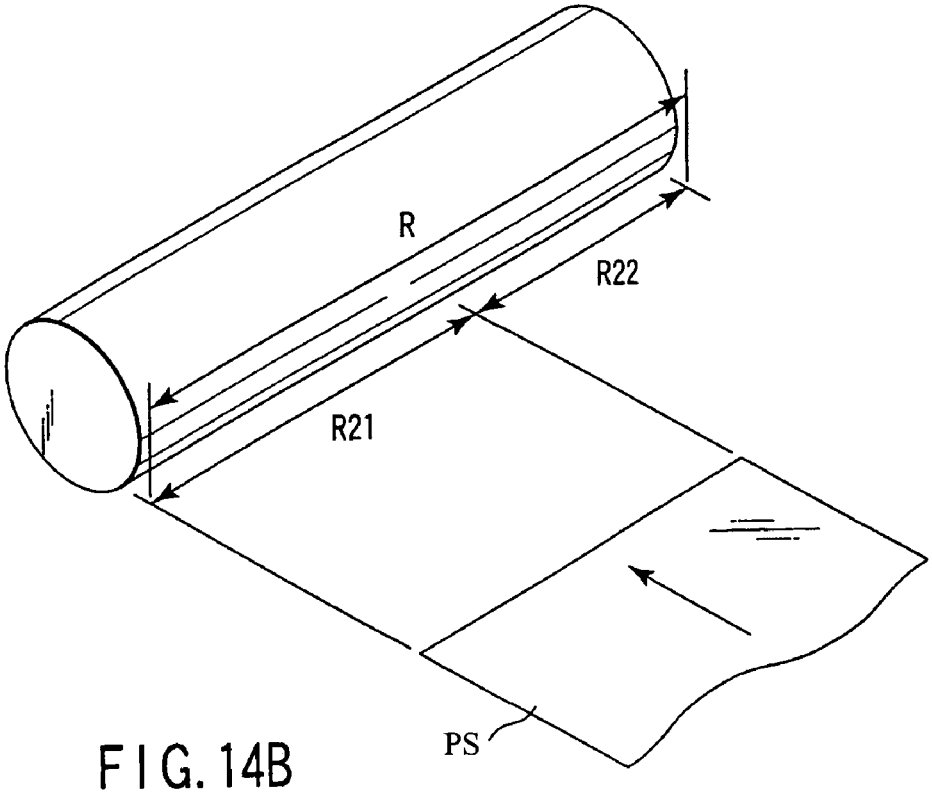

The present invention is not limited to the above-mentioned type. The invention is also applicable to a fixing apparatus of the type that the area R21 which can pass the center of paper in the area R of the heating roller 2 to pass a paper sheet is set aligned with one end of the heating roller 2 in the length direction, and the marginal area R22 is set adjacent to the area R21, as shown in FIG. 14B.

Next, explanation will be given on an example of a fixing apparatus of the type shown in FIG. 14B.

Figure 15A:
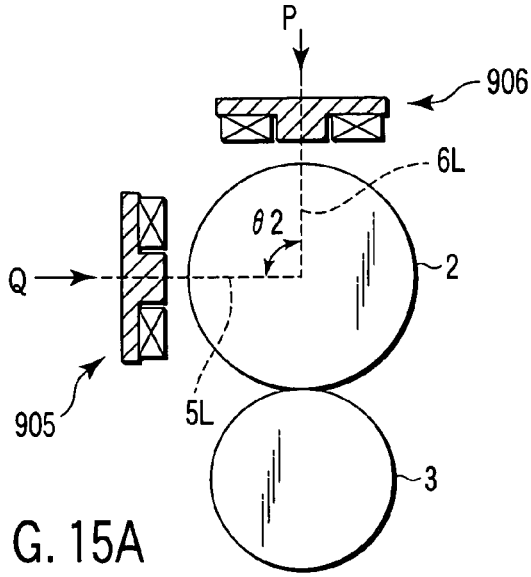
FIGS. 15A, 15B and 15C are schematic diagrams explaining other examples of the induction heating mechanism shown in FIG. 2.

As shown in FIG. 15A, a fixing apparatus having the areas R21 and R22 has a heating roller 2 and a pressing roller 3, like the fixing apparatus shown in FIG. 1. The fixing apparatus further includes a coil body 905 arranged opposite to the area R21 (the area where a paper sheet P passes frequently) outside the heating roller, and a coil body 906 arranged opposite to the area R22 outside the heating roller 2.

Figure 15B:
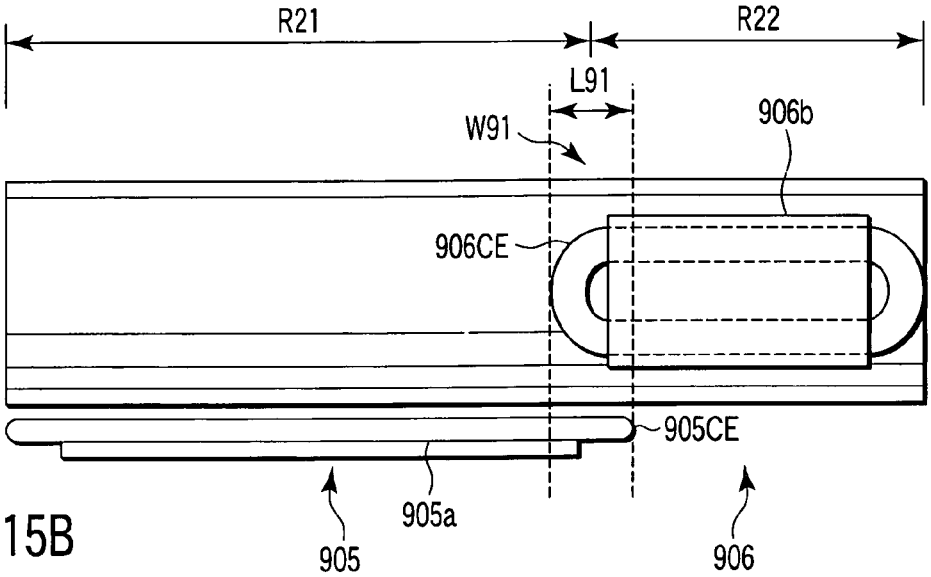
Figure 15C:
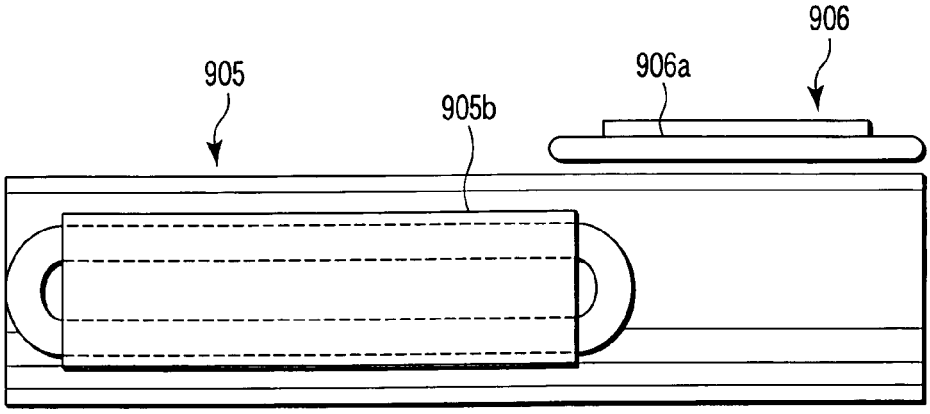

The coil bodies 905 and 906 show the state that the angle θ2 formed by virtual lines 5L and 6L which connect the axis of the heating roller 2 to the centers of the coil bodies 905 and 906 is larger than 0° in the state viewed from the axial direction of the heating roller 2, like the coil bodies 805 and 806 explained in FIG. 13A. FIG. 15A shows the relationship between the coil bodies 905 and 906 with the angle θ2 of 90° and the heating roller 2. FIG. 15B is a schematic perspective view seen from the arrow P direction of FIG. 15A. FIG. 15C is a schematic perspective view seen from the arrow Q direction of FIG. 15A.

The coil body 905 has an exciting coil 905*a*, and a magnetic core 905*b* for holding the exciting coil 905*a*. The coil body 906 has an exciting coil 906*a*, and a magnetic core 906*b* for holding the exciting coil 906*a*.

The exciting coils 905*a* and 906*a* have the largeness that the adjacent coils are overlapped in the joint W91 of the exciting coils, when they are arranged linearly outside the heating roller 2. The exciting coil 905*a* is arranged at a different angle and phase so that the end part 905CE is not overlapped with the end part 906CE of the exciting coil 906*a*.

Therefore, the heating roller 2 has the joint W91 of the exciting coils where a predetermined magnetic field is supplied from both exciting coils 905*a* and 906*a*, in the area divided in the direction orthogonal to the axial direction, when electric power is supplied to the exciting coils 905*a* and 906*a*.

The size of the coil bodies 905 and 906 is set to a predetermined value by evaluating the temperature based on the result of using the fixing apparatus (when passing a paper sheet PS). In this example, when the coils are aligned outside the heating roller 2, the length L91 where the adjacent coils are overlapped is 0 mm.

Figure 16:
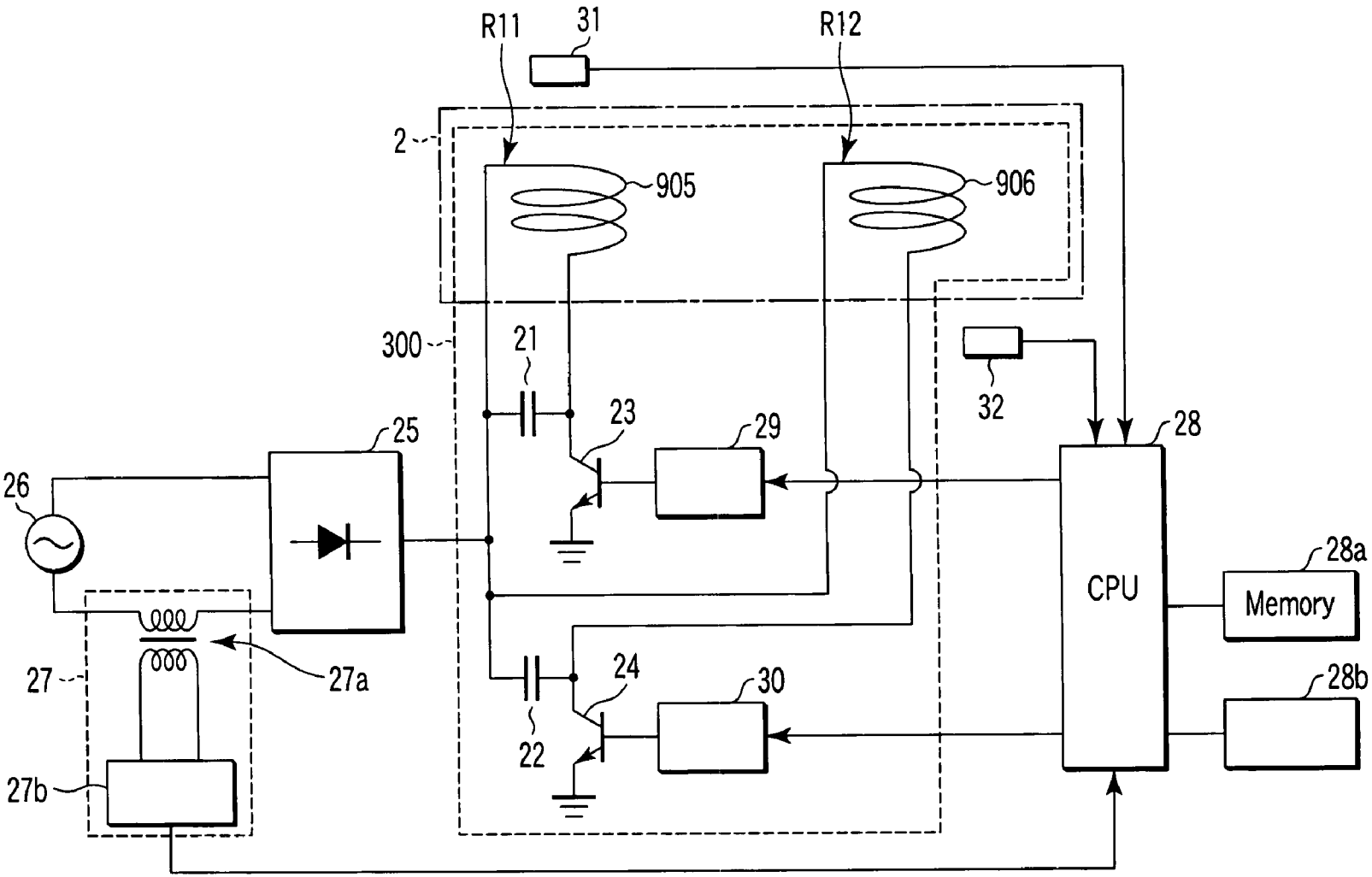
FIG. 16 is a block diagram explaining a configuration of an induction heating control circuit applicable to the fixing apparatuses shown in FIG. 15A, 15B and 15C.

Next, explanation will be given on the configuration of an electric circuit applicable to the fixing apparatus, and a method of operating the fixing apparatus, by referring to FIG. 16. This electric circuit has a coil current control circuit 300, and has the same configuration as the circuit shown in FIG. 2, except the coil current control circuit 200, and detailed explanation is omitted.

The coil current control circuit 300 has an exciting coil 905*a* which supplies a magnetic field to the area R21 of the heating roller 2, and an exciting coil 906*a* which supplies a magnetic field to the area R22 of the heating roller 2. Namely, one end of the exciting coil 905*a* is aligned with one end of the heating roller 2 in the length direction, so that the coil faces to the area R21 to pass the center of paper in the area R of the heating roller 2 which can pass a paper sheet, and the exciting coil 906*a* is placed adjacent to the exciting coil 905*a*.

The exciting coil 905*a* is connected in parallel with the resonance condenser 21, and is connected in series with the switching element 23. The exciting coil 906*a* is connected in parallel with the resonance condenser 22, and is connected in series with the switching element 24.

The same method as the method of operating the fixing apparatus explained by using FIGS. 2 and 3 is applicable to this fixing apparatus.

Namely, a method of supplying electric power alternately to the exciting coils 905*a* and 906*a* at a predetermined ratio (a time ratio), and a method of supplying predetermined electric power simultaneously to the exciting coils 905*a* and 906*a*, as shown in FIG. 3, can be applied.

Therefore, as explained above, by using any method, it is possible to make uniform the intensity of the magnetic field supplied from the exciting coils 905*a*/906*a* and the temperature distribution in the length direction of the heating roller 2.

The above-mentioned embodiment explains a fixing apparatus of the type that the foamed rubber 2*b* is provided inside the heating roller 2, as shown in FIG. 1. The present invention is not limited to this type. The fixing apparatuses shown in FIGS. 17A–17C are also permitted.

Figure 17A:
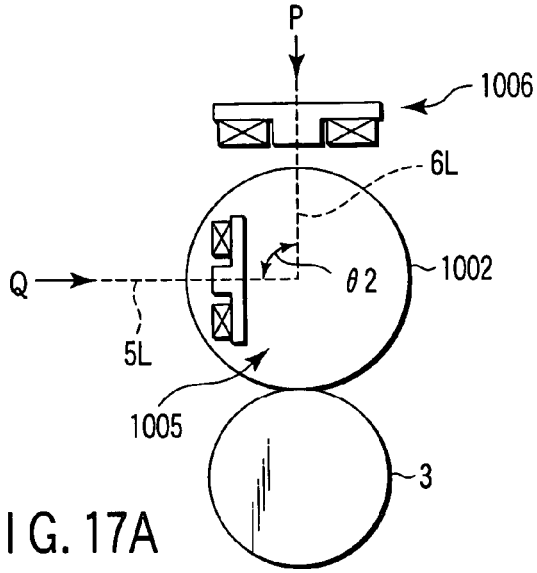
FIGS. 17A, 17B and 17C are schematic diagrams explaining still other examples of the induction heating mechanism shown in FIG. 2.
Figure 17B:
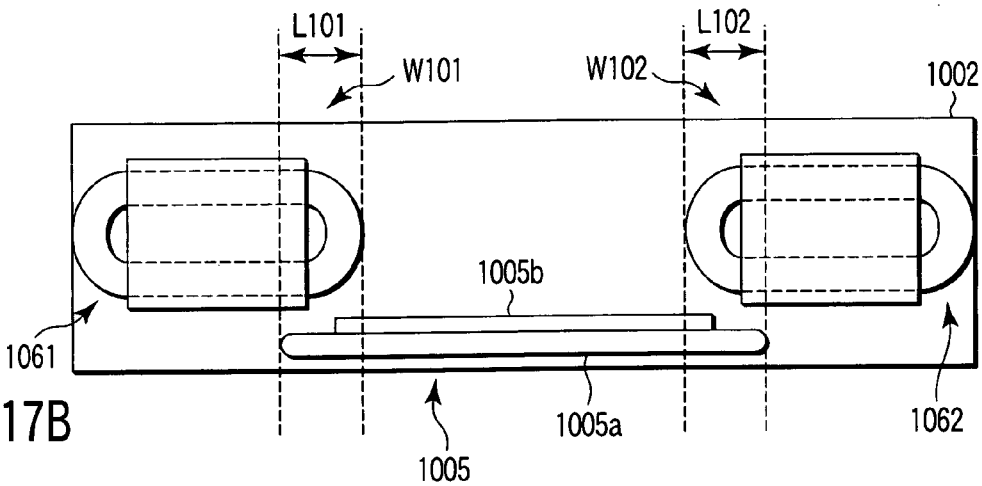
Figure 17C:
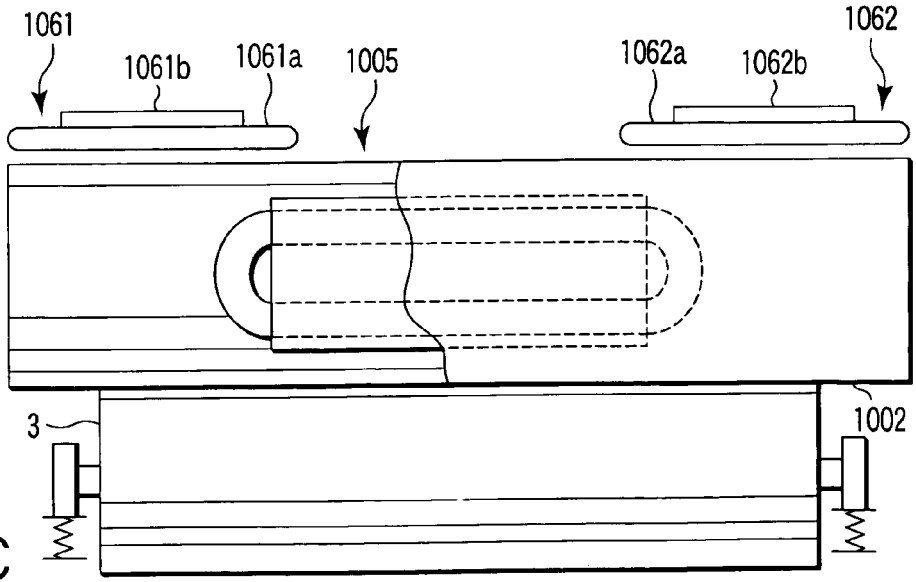

As shown in FIG. 17A, this fixing apparatus has a heating member 1002, a coil body 1005 provided inside the heating member 1002, and a coil body 1006 provided outside the heating member 1002. The other components of this fixing apparatus are the same as those of the fixing apparatus shown in FIG. 1, and detailed explanation is omitted.

The heating member (heating roller) 1002 is an endless belt which is made of conductive material such as nickel, stainless steel, copper, aluminum, stainless steel and aluminum alloy, and iron, and shaped cylindrical with a predetermined circumference, and has a predetermined hardness, and is kept in a predetermined form by an external force.

Like the coil bodies 805 and 806 explained in FIG. 13*a*, the coil bodies 1005 and 1006 show the state that the angle θ2 formed by virtual lines 5L and 6L which connect the axis of the heating roller 2 to the centers of the coil bodies 1005 and 1006 is larger than 90° in the state viewed from the axial direction of the heating roller 2.

The coil body 1006 includes coil bodies 1061 and 1062 connected in series, and is formed electrically as one coil. The angle θ2 is not limited to this value, and may be 0°.

FIG. 17B is a schematic perspective view seen from the arrow P direction of FIG. 17A. FIG. 17C is a schematic perspective view seen from the arrow Q of FIG. 17A.

The coil body 1005 has an exciting coil 1005*a*, and a magnetic core 1005*b* holding the excitation coil 1005*a*. The coil bodies 1061 and 1062 have exciting coils 1061*a* and 1062*a*, and magnetic cores 1061*b* and 1062*b* holding the exciting coils 1061*a* and 1062*a*.

The exciting coils 1005*a*, 1061*a* and 1062*a* have a size such that the adjacent coils are overlapped, in the joints W101 and W102 of the exciting coils, when they are aligned outside the heating roller 2.

The exciting coils 1061*a* and 1062*a* are arranged outside the heating roller 2, so that the centers of the coils are aligned (at the same angle and phase). The exciting coil 1005 is arranged inside the heating roller 2, so as to overlap with the exciting coils 1061*a* and 1062*a* in the joints W101 and W102.

Therefore, when electric power is supplied to the exciting coils 1005*a*, 1061*a* and 1062*a*, the heating roller 2 has a joint W101 of the exciting coils where a predetermined magnetic field is supplied from both exciting coils 1005*a* and 1061*a*, and a joint W102 of the exciting coils where a predetermined magnetic field is supplied from both exciting coils 1005*a* and 1062*a*.

The size of the coil bodies 1005*a*, 1061*a* and 1062*a* is set to a predetermined value by evaluating the temperature based on the result of using the fixing apparatus (when passing a paper sheet P). In this example, when the coils are aligned outside the heating roller 2, the lengths L101 and L102 where the adjacent coils are overlapped are 10 mm, respectively.

The fixing apparatus explained above, the exciting coils provided in the fixing apparatus and the method of controlling the fixing apparatus can be combined optionally.

Next, explanation will be given on a modification of the induction heating control circuit sown in

FIG. 2.

Figure 18:
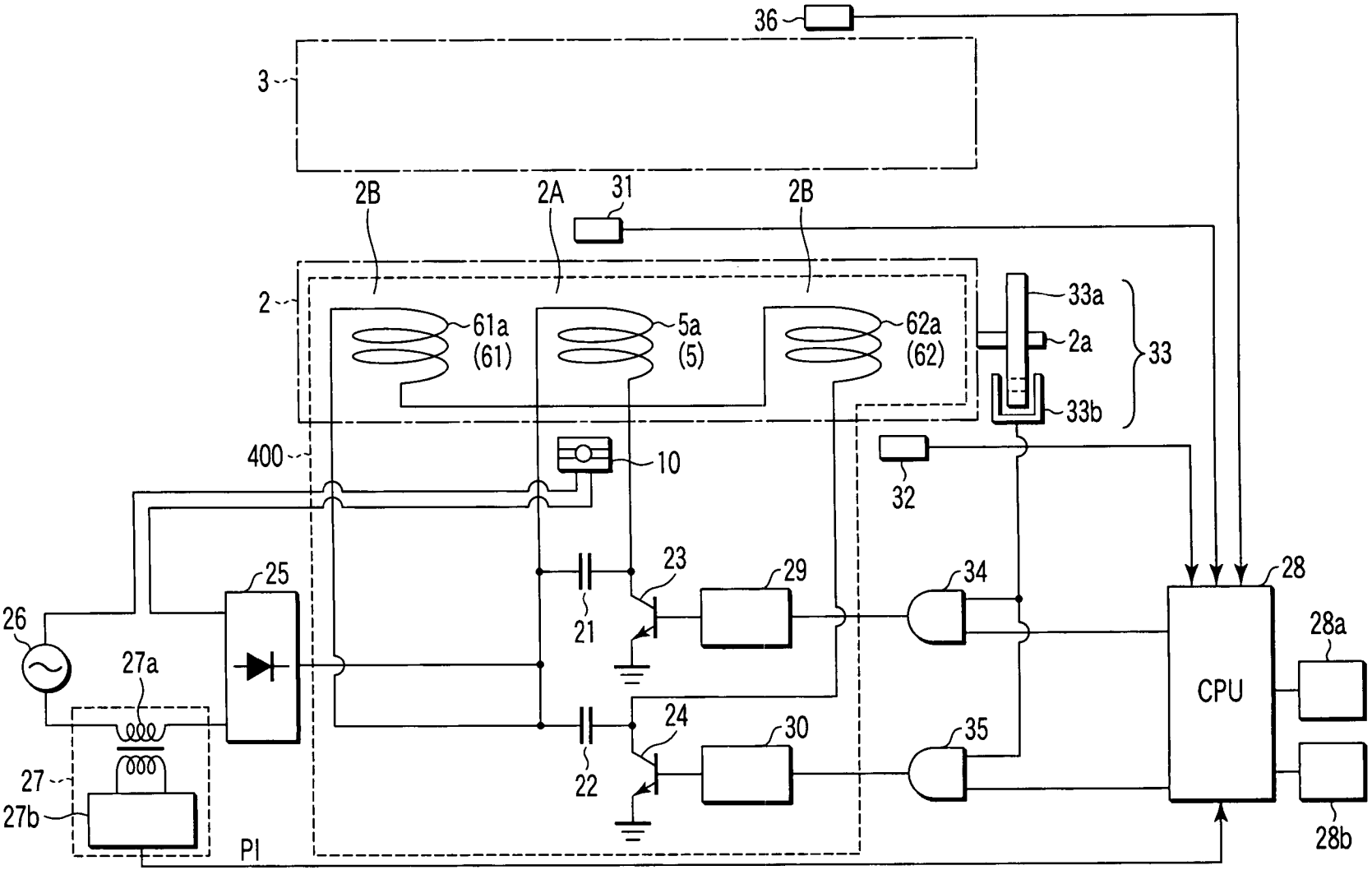
FIG. 18 is a block diagram explaining a configuration of another induction heating control circuit applicable to the fixing apparatus shown in FIG. 1.

As shown in FIG. 18, the core metal 2*a* of the heating roller 2 is provided with a rotation detection mechanism 33 which can detect rotation of the heating roller 2.

The rotation detection mechanism 33 detects rotation of the heating roller 2 by detecting that a pulse plate (FG plate) 33*a* fixed to the core metal 2*a* (shaft) or the like of the heating roller 2 is rotated together with the heating roller 2, by a photo-sensor 33*b* fixed to a predetermined position of the fixing apparatus 1. The rotation detection mechanism 33 is not limited to this configuration. It is also permitted to detect rotation of the heating roller 2 by detecting a marking at the predetermined position on the outer circumference of the heating roller 2 by using an optical detection means or the like. As explained above, by using a rotation detection mechanism, the heating roller 2 is prevented from being heated to an abnormal temperature, and the safety of the fixing apparatus is improved.

The rotation detection mechanism 33 is connected to the input terminal of an AND circuit 34 whose input terminal is connected to the IGBT driving circuit 29, and the input terminal of an AND circuit 35 whose output terminal is connected to the IGBT circuit 30. The input terminals of the AND circuits 34 and 35 are connected to the CPU 28. The IGBT circuits 29 and 30 are part of a coil current control system 400.

Therefore, the AND circuit 34 outputs a signal (hereinafter, referred to as a driving signal) to drive the IGBT driving circuit 29, when receiving a rotation detection signal from the rotation detection mechanism 33, and an instruction signal (hereinafter, referred to as an excitation control signal) to drive the IGBT driving circuit 29 from the CPU 28. Receiving the driving signal, the IGBT driving circuit 29 turns on the switching element 23, and supplies a predetermined electric power to the exciting coil 5*a*.

Similarly, the AND circuit 35 outputs a driving signal to drive the IGBT driving circuit 30, when receiving a rotation detection signal from the rotation detection mechanism 33, and an excitation control signal to drive the IGBT driving circuit 30 from the CPU 28. Receiving the driving signal, the IGBT driving circuit 30 turns on the switching element 24, and supplies a predetermined electric power to the exciting coils 61*a* and 62*a*.

Namely, electric power is supplied to the exciting coils 5*a*, 61*a* and 62*a* while the heating roller 2 is rotating, and not supplied when the heating roller 2 is stopping.

Therefore, even if a trouble should occur in the CPU 28 or thermistors 9*a* and 9*b*, the heating roller 2 is not heated by the exciting coils 5*a* and 6*a* as long as it is not rotated. This prevents the outer circumference of the heating roller 2 from being heated locally to an abnormal temperature, and the safety of the fixing apparatus 1 is remarkably increased over those currently in use.

To increase the safety furthermore, it is permitted to provide a temperature detection mechanism (a thermistor) 36 which detects the temperature of the pressing roller 3, at a predetermined position in proximity to the outer circumference of the pressing roller 3. When the rotation detection signal and excitation control signal are applied to one of the AND circuits 34 and 35, the temperature of the pressing roller 3 is increased in a predetermined range by the thermal conduction from the rotating heating roller 2. Namely, based on the temperature information of the pressing roller 3 from the thermistor 36, it can be determined that the heating roller 2 is rotating when the temperature of the pressing roller 3 output from the thermistor 36 is increased to a predetermined range, and the heating roller is not rotating when the temperature of the heating roller 3 is not increased.

Because of the above reason, the CPU 28 is set to output the excitation control signal to one of the AND circuits 34 and 35 only when the temperature of the pressing roller 3 is increased to a predetermined range. Thus, even in the case of a malfunction that the rotation detection signal is applied to the AND circuit 31 or 32, the excitation control signal is not outputted and electric power is not supplied to the exciting coils 5*a*, 61*a* and 62*a*, though the heating roller 2 is not rotating.

Thus, even if a trouble occurs in the rotation detection mechanism 33 or thermistors 9*a* and 9*b*, the heating roller 2 is not heated by the exciting coils 5*a* and 6*a* if it is not rotating. Therefore, the outer circumference of the heating roller 2 is prevented from being heated locally to an abnormal temperature.

Further, the rotation detection mechanism 33 may detect the rotation speed of the heating roller 2. By feeding back the detection result, the CPU 28 can maintain the rotation speed of the heating roller 2 at a constant level. Therefore, an appropriate image is formed on a paper sheet passing between the heating roller 2 and the pressing roller 3.

As explained in FIG. 2, the first inverter circuit includes the condenser 21 and switching element 23, and supplies electric power to the exciting coil 5*a*. The second inverter circuit includes the condenser 22 and switching element 24, and supplies electric power to the exciting coils 61*a* and 62*a*. The first and second inverter circuits are connected to the IGBT driving circuits 29 and 30, respectively. The first and second inverter circuits form a self-excited oscillator which utilizes the resonance by the exciting coils and condensers, and supplies a high-frequency current efficiently to the exciting coils.

Next, the operation of the self-exited oscillator will be explained.

FIGS. 19A, 19B, 19C and 19D show an equivalent circuit EC of the first inverter circuit, and are circuit diagrams explaining the current flowing in the equivalent circuit EC. FIGS. 20A and 20B are reference drawings showing the relationship between the time and current flowing in the equivalent circuit EC of the first inverter circuit.

As shown in FIG. 20A, a current having a predetermined frequency corresponding to the ON time (O-P time) of the switching element 23 turned on/off by the CPU 28 flows in the equivalent circuit EC of the first inverter circuit. One period of this frequency is time O-S.

Figure 19A:
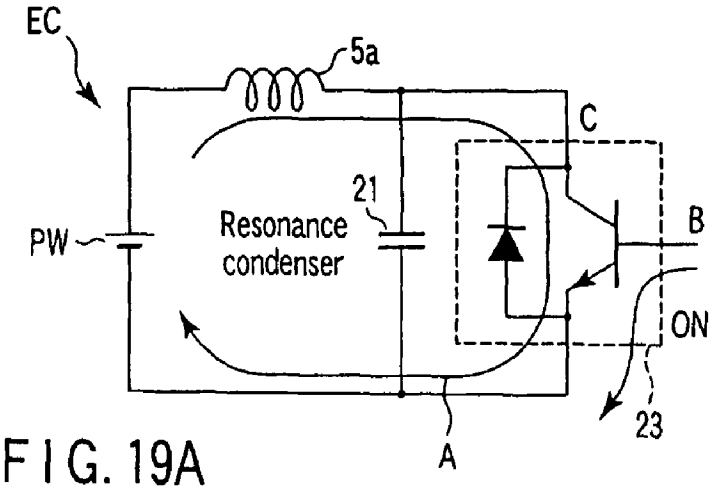
FIGS. 19A, 19B, 19C and 19D are circuit diagrams explaining the flow of current in an equivalent circuit of the inverter circuit shown in FIG. 18.
Figure 19B:
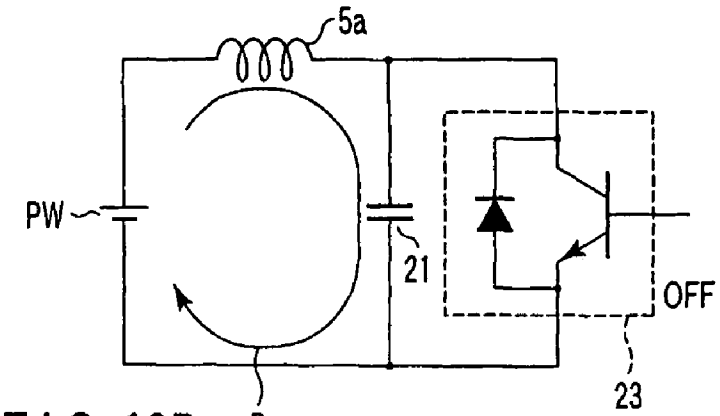
Figure 20B:
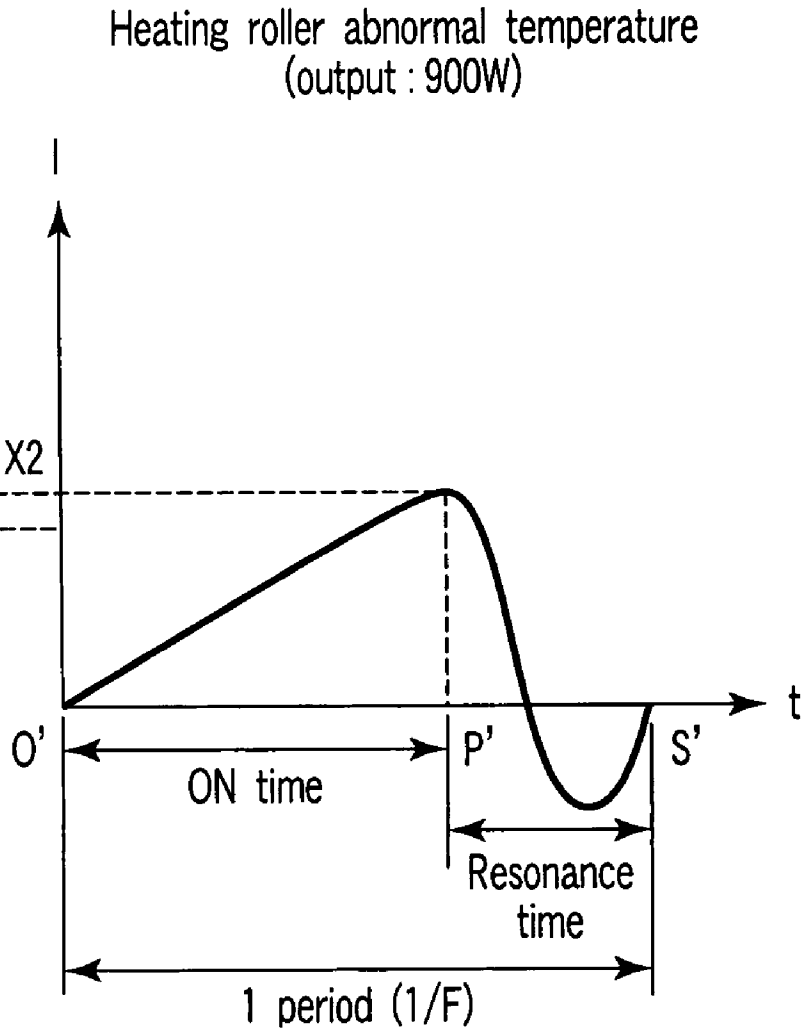
FIGS. 20A and 20B are reference drawings showing the relationship between the time and the current flowing in the equivalent circuit of the inverter circuit shown in FIG. 18.
Figure 20A:
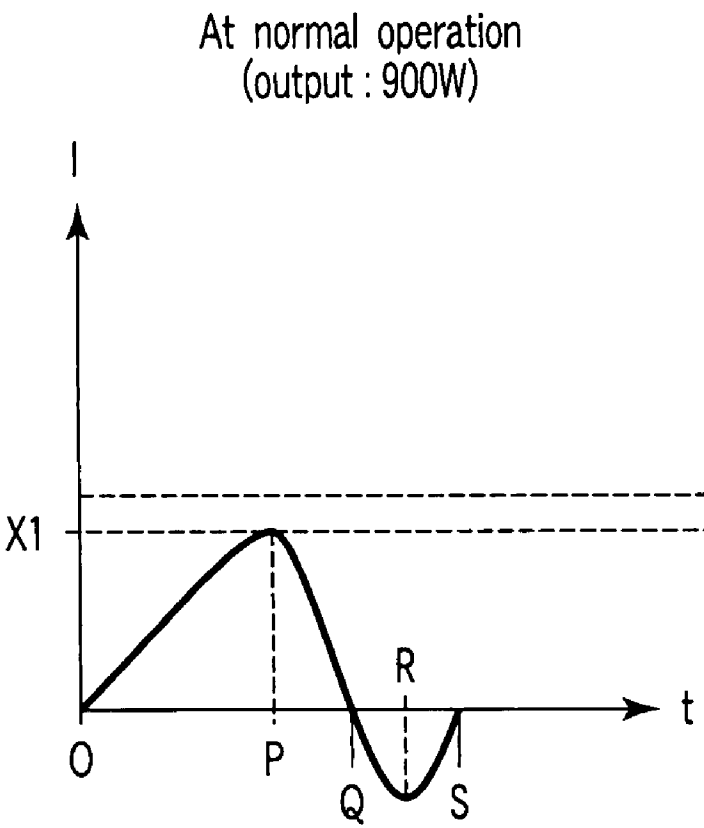

As shown in FIG. 19A, after the time O-P, a current from a power supply PW flows in the turned-on switching element 23 and exciting coil 5*a*, as indicated by the arrow A. When the switching element 23 turns off, the current flowing in the switching element 23 flows in the resonance condenser 21 as indicated by the arrow B in FIG. 19B, and the resonance condenser 21 is charged in the time P-Q.

Figure 19C:
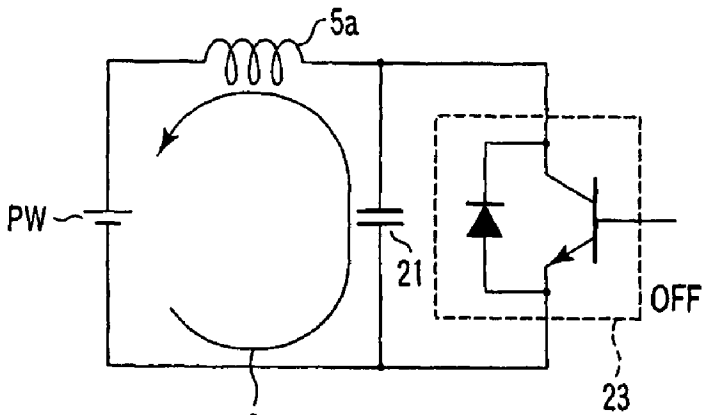
Figure 19D:
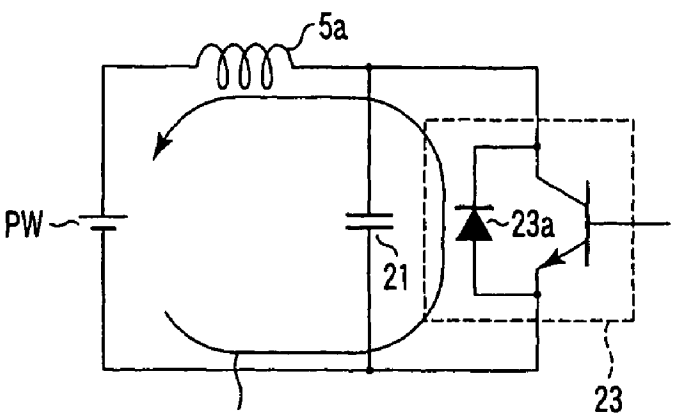

The charged resonance condenser 21 starts discharging, as shown in FIG. 19C. A reverse current as indicated by the arrow C flows in the discharged resonance condenser 21, and after the time Q-R, the voltage becomes zero. But, this reverse current cannot stop at once, and flows into the diode 23*a* of the switching element 23, and flows for the time R-S as indicated by the arrow D in FIG. 19D.

When the switching element 23 turns on again, a predetermined current flows in the exciting coil 5*a*. By repeating this period O-S, the heating roller 2 is supplied with a predetermined magnetic field, and heated. The value X1 of the current flowing in the exciting coil 5*a* in the time P is a peak current value. This peak current value X1 can be calculated by feeding back the input power PI monitored by the input power monitor 27 explained before to the CPU 28. This input power PI is determined based on the thermal output (W) of the heating roller 2 heated by the magnetic field supplied from the exciting coil 5*a*.

The thermal output of the heating roller 2 is the heat energy generated when the heating roller 2 flowing an eddy current is heated by the magnetic field generated corresponding to the predetermined current value flowing in the exciting coil 5*a*, and is defined by the energy obtained by subtracting a predetermined energy consumed by the induction heating from the input power PI monitored by the input power monitor 27, for example.

Therefore, the temperature of the heating roller 2 based on the energy generated when the heating roller 2 is heated can be detected by monitoring the input power PI and calculating the peak current value X1 of the exciting coil 5*a*.

The exciting coil 5*a* and heating roller 2 have a predetermined magnetic characteristic (magnetic coupling), and the peak current value X1, frequency and voltage of the current supplied to the exciting coil 5*a* are determined by this magnetic characteristic. This magnetic characteristic is initially determined by the permeability and resistivity of the heating roller 2, the number of turns (windings) of the exciting coil 5*a* and the position of the magnetic core 5*b*.

However, when the heating roller 2 is heated to an abnormal temperature, the exciting coil 5*a* is heated to a predetermined temperature by the radiant heat from the heating roller 2, and the magnetic characteristic of the heated exciting coil 5*a* is changed to the characteristic different from that before heated. Namely, this magnetic characteristic has temperature dependability.

FIG. 20B shows the relationship between the time and the current flowing in the exciting coil 5*a* having the changed magnetic characteristic. FIGS. 20A and 20B show the relationship between the time and the current flowing in the exciting coil 5*a* when the thermal output of the heating roller 2 is set to 900 W.

As shown in FIG. 20B a current with a peak current value X2 larger than the peak current value X1 flows in the exciting coil 5*a* whose magnetic characteristic has been changed as a result of an abnormal temperature rise in that the heating roller 2. The frequency of this current changes also to 1 period O'-S' longer than the period O-S, that is, the frequency is decreased.

Therefore, the CPU 28 judges that the heating roller 2 is increased to an abnormal temperature based on the value set according to the frequency value of the predetermined current supplied to the exciting coil 5*a*, when the input power PI fed back from the input power monitor 27, or the peak current value is not maintained in a predetermined range. This set value (threshold value) is the frequency and peak current value having a predetermined range according to the magnetic characteristics of the exciting coil 5*a* and heating roller 2, and is stored in the memory of the CPU 28. For example, when the thermal output of the heating roller 2 is 700 W, the peak value of the current flowing in the exciting coil 5*a* is 55A, and the frequency is 26 kHz. When the thermal output is 900 W, the peak current value is 60A, and the frequency is 23 kHz. When the thermal output is 1200 W, the peak current value is 65A, and the frequency is 21 kHz.

For example, when the set thermal output of the heating roller 2 is 900 W and the temperature of the heating roller 2 is about 1500°, as shown in FIG. 20A, the peak value X1 of the current flowing in the exciting coil 5*a* is 50A. But, when the heating roller 2 is heated to an abnormal temperature (e.g. 300°) and the magnetic characteristic is changed, a current with a peak value X2 of 60A flows in the exciting coil 5*a*. By calculating the change in the peak current value from the input power PI fed back from the input power monitor 27, the CPU 28 detects that the frequency shown in FIG. 20B is decreased, that is, the thermal output supplied to the heating roller 2 is increased.

When detecting the increased thermal output supplied to the heating roller 2, the CPU 28 stops the power supplied to the exciting coil 5*a*.

As shown in FIGS. 20A and 20B, the frequency of the current supplied to the exciting coil 5*a* can be calculated by detecting the ON time of the switching element 23. This frequency is defined by the value of the ON time of the switching element 23 plus the resonance time of the resonance condenser 21.

The CPU 28 is connected to a timer 28*b* for detecting the ON time of the switching element 23 (FIG. 2). The memory 28*a* connected to the CPU 28 stores the threshold value to set the ON time of the switching element 23 and resonance time of the resonance condenser 21 according to the magnetic characteristics of the exciting coil 5*a* and magnetic core 5*b*.

Therefore, the CPU 28 compares the detected ON time of the switching element 23 with the preset threshold value, and judges that the frequency is decreased when the ON time is longer than the threshold value. When this frequency is lowered below the set value explained above, for example, the CPU 28 cuts off the power supplied to the exciting coil 5*a* to increase the temperature of the heating roller 2 to an abnormal value.

Therefore, even if the heating roller 2 is stopped, electric power to increase the temperature of the heating roller 2 to an abnormal value is not supplied to the exciting coil 5*a*, and the heating roller 2 is prevented from being heated locally.

Further, it is possible to detect an error in the heating roller 2 without using an abnormal temperature detection mechanism, and the safety of the fixing apparatus 1 is remarkably increased over those currently in use.

Of course, a similar method of detecting an abnormal temperature can be applied to the exciting coils 61*a* and 62*a*.

This embodiment can also use the method of detecting an abnormal temperature which utilizes the changes in the magnetic characteristics of the magnetic cores 5*b*, 61*b* and 62*b* holding the exciting coils 5*a*, 61*a* and 62*a*, respectively, when heated by the radiant heat of the heating roller 2.

The magnetic cores 5*b*, 61*b* and 62*b* are composed of materials whose magnetic characteristic is saturated and changed after passing a predetermined Curie point when the heating roller 2 is heated to an abnormal temperature.

This Curie point is preferably a temperature value a little higher than the normal temperature ranges of the magnetic cores 5*b*, 61*b* and 62*b*, by evaluating the temperatures of the magnetic cores 5*b*, 61*b* and 62*b* when exceeding the normal temperature range, so that the Curie point is not exceeded while the heating roller 2 is heated within a preset normal temperature range.

When the temperature of the heating roller 2 exceeds the preset normal temperature range, the temperatures of magnetic cores 5*b*, 61*b* and 62*b* exceed the Curie point, cause magnetic saturation, and then the magnetic characteristics are changed from the magnetic characteristics of the exciting coils 5*a*, 61*a* and 62*a*. Thus, the current value (peak value) flowing in the exciting coils 5*a*, 61*a* and 62*a* is changed. This change in the current value is detected by the CPU 28 by comparing the input power PI fed back from the input power monitor 27 with the set value as explained above.

When detecting the changes in the magnetic characteristics of the exciting coil 5*a* and magnetic core 5*b* caused by the changes in the current value, the CPU 28 stops the power supplied to the exciting coil 5*a*.

Therefore, even if the heating roller 2 is stopped, the exciting coil 5*a* is not supplied with electric power to increase the temperature of the heating roller to an abnormal value, and the heating roller 2 is prevented from being heated locally.

An error in the heating roller 2 can be detected without using an abnormal temperature detection mechanism, and the safety of the fixing apparatus 1 is remarkably increased over those currently in use.

The fixing apparatus explained above, the exciting coil provided in the fixing apparatus and the method of controlling the fixing apparatus can be combined optionally.

As explained above, the fixing apparatus of the present invention makes the temperature distribution uniform in the length direction of the heating roller, and provides a good image, by preventing a temperature drop at the joints of the heating rollers.

As explained above, the fixing apparatus of the present invention makes the temperature distribution uniform in the length direction of the heating roller, by preventing a temperature drop at the joints of the coils of the heating rollers, thereby providing a good image.

The fixing apparatus of the present invention makes the temperature distribution uniform in the length direction of the heating roller, by preventing a temperature drop at the joints of the coils of the heating roller, providing a good image.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a heating member which has a cylindrical shape and has a conductor to flow an induced current by induction heating;

a pressing member which supplies a pressure to the heating member;

a first induction heating mechanism which includes a first coil;

a second induction heating mechanism which includes at least one second coil aligned with the first induction heating mechanism in an axial direction of the heating member;

wherein an end part of the first coil adjacent to the second coil is inclined over 90° to an opposite side of the heating member.

2. The fixing apparatus according to claim 1, wherein the first and second coils have a wide interval between their respective central parts and the heating member, compared with the interval between their respective end parts and the heating member.

3. The fixing apparatus according to claim 1, wherein the first and second coils have a specific curvature corresponding to the outer circumference of the heating member.

4. The fixing apparatus according to claim 1, further comprising an abnormal temperature detection mechanism, wherein the abnormal temperature detection mechanism cuts off the power supplied to the first and second coils when the temperature of the heating member reaches an abnormal value, and is arranged in a space with no wires at a center area of the first coil.

5. The fixing apparatus according to claim 1, further comprising an abnormal temperature detection mechanism, wherein the abnormal temperature detection mechanism has a temperature detector which detects the temperature between an outer circumference of the heating member and the second coil, and a heat pipe which transmits the heat of the temperature detector; and cuts off the power supplied to the first and second coils based on the detection result, when the heating member reaches an abnormal temperature; and the temperature detector is arranged close to or contacting the heating member.

6. The fixing apparatus according to claim 1, further comprising a rotation detection mechanism, a main control mechanism, and an induction heating control mechanism;

wherein the rotation detection mechanism detects rotation of the heating member, and outputs a rotation detection signal;

the main control mechanism outputs an instruction signal to supply specific electric power to the first and second coils; and the induction heating control mechanism supplies specific electric power to the first and second coils, when receiving the rotation detection signal and instruction signal.

7. The fixing apparatus according to claim 1, wherein the first coil faces to the outer circumference of the heating member where a transferred material contacts frequently when passing between the heating member and pressing member; and the second coil being arranged in two pieces at both ends of the first coil in the axial direction of the heating member, and electrically connected in series.

8. A fixing apparatus comprising:

a heating member which has a cylindrical shape and has a conductor to flow an induced current by induction heating;

a pressing member which supplies a pressure to the heating member;

a first induction heating mechanism which includes a first coil;

a second induction heating mechanism which includes at least one second coil aligned with the first induction heating mechanism in an axial direction of the heating member;

wherein the first coil has a narrow interval between a central part of the first coil and the heating member, compared with the interval between an end part of the first coil, adjacent to the second coil, and the heating member; and the second coil has a narrow interval between a central part of the second coil and the heating member, compared with the interval between an end part of the second coil, adjacent to the first coil, and the heating member.

9. The fixing apparatus according to claim 8, wherein the end part of the first coil adjacent to the second coil is inclined over 90° to the opposite side of the heating member.

10. The fixing apparatus according to claim 9, further comprising a magnetic field shielding plate interposed between the first coil and the second coil.

11. The fixing apparatus according to claim 9, wherein the first and second coils have a specific curvature corresponding to an outer circumference of the heating member.

12. The fixing apparatus according to claim 8, wherein the first and second coils have a wide interval between their respective central parts and the heating member, compared with the interval between their respective end parts and the heating member.

13. The fixing apparatus according to claim 8, wherein the first and second coils have a specific curvature corresponding to an outer circumference of the heating member.

14. A fixing apparatus comprising:

a heating member which has a cylindrical shape and has a conductor to flow an induced current by induction heating;

a pressing member which supplies a pressure to the heating member;

a first induction heating mechanism which includes a first coil;

a second induction heating mechanism which includes at least one second coil aligned with the first induction heating mechanism in an axial direction of the heating member;

wherein the second coil has a first interval between a central part of the second coil and the heating member, and a second interval between an end part of the second coil, adjacent to the first coil, and the heating member, the first interval being narrow as compared with the second interval;

the first coil has a second interval to the heating member in both a central part of the first coil and an end part of the first coil; and the end part of the first coil, and the end part of the second coil adjacent to the end part of the first coil, are overlapped without contacting each other in a radial direction with respect to the heating member.

15. The fixing apparatus according to claim 14, wherein the first interval is equal to the second interval.

16. A fixing apparatus comprising:

a heating member which has a cylindrical shape and has a conductor to flow an induced current by induction heating;

a pressing member which supplies a pressure to the heating member;

a first induction heating mechanism which includes a first coil;

a second induction heating mechanism which includes at least one second coil aligned with the first induction heating mechanism in an axial direction of the heating member; and an abnormal temperature detection mechanism that cuts off the power supplied to the first and second coils when the temperature of the heating member reaches an abnormal value, and is arranged between the first and second coils.

17. A fixing apparatus comprising:

a heating member which has a cylindrical shape and has a conductor to flow an induced current by induction heating;

a pressing member which supplies a pressure to the heating member;

a first induction heating mechanism which includes a first coil, the first coil having a substantially elliptic shape and a space defined therein;

a second induction heating mechanism which includes at least one second coil arranged at a position different from a position of the first coil in a direction of rotation of the heating member, the second coil having a substantially elliptic shape and a space defined therein, wherein an end of the first coil overlaps with an end of the second coil in the direction of rotation of the heating member, and part of the space of the first coil overlaps with the part of the space of the second coil.

18. The fixing apparatus according to claim 17, wherein the first and second coils are arranged outside the heating member.

19. The fixing apparatus according to claim 17, wherein the first coil is arranged inside the heating member; and the second coil is arranged outside the heating member.

* * * * *